US008777022B2

(12) United States Patent
Artigues et al.

(10) Patent No.: US 8,777,022 B2
(45) Date of Patent: Jul. 15, 2014

(54) UNIVERSAL STORAGE AND SHELVING SYSTEM

(76) Inventors: Constance Artigues, Greenwood Village, CO (US); Dan E. Jensen, Aurora, CO (US); Eric E. Scott, Denver, CO (US)

( * ) Notice: Subject to any disclaimer, the term of this patent is extended or adjusted under 35 U.S.C. 154(b) by 524 days.

(21) Appl. No.: 13/068,096

(22) Filed: May 2, 2011

(65) Prior Publication Data

US 2011/0266237 A1 Nov. 3, 2011

Related U.S. Application Data

(60) Provisional application No. 61/343,742, filed on May 3, 2010.

(51) Int. Cl.

| | |
|---|---|
| ***A47F 5/08*** | (2006.01) |
| ***A47B 45/00*** | (2006.01) |
| ***A47B 96/02*** | (2006.01) |
| ***A47F 5/00*** | (2006.01) |
| ***A47B 95/00*** | (2006.01) |
| ***A47B 61/00*** | (2006.01) |

(52) U.S. Cl.

CPC ..... *A47F 5/0018* (2013.01); *A47B 45/00* (2013.01); *A47B 96/025* (2013.01); *A47B 95/008* (2013.01); *A47B 96/024* (2013.01); *A47B 61/003* (2013.01)

USPC ..... 211/90.02; 211/187

(58) Field of Classification Search

USPC ..... 211/87.01, 88.02, 88.04, 90.01, 90.02, 211/119.003, 123, 186, 153, 134, 189, 195, 211/204, 206, 187, 41.12, 90.04, 94.03, 211/105.1, 125.15; 108/180, 185

See application file for complete search history.

(56) References Cited

U.S. PATENT DOCUMENTS

| | | | | | |
|---|---|---|---|---|---|
| 2,720,316 | A | * | 10/1955 | Glascott | 108/28 |
| 3,648,626 | A | * | 3/1972 | Schuster | 108/42 |
| 3,698,329 | A | * | 10/1972 | Diamond et al. | 108/42 |
| 3,836,009 | A | * | 9/1974 | Horowitz et al. | 211/90.04 |
| 4,155,312 | A | * | 5/1979 | Thorkildson | 108/137 |
| 4,491,226 | A | * | 1/1985 | Marschak | 211/186 |
| 4,500,146 | A | * | 2/1985 | Peterson | 312/257.1 |

(Continued)

OTHER PUBLICATIONS

Walker Garage Interiors, LLC; "ineedclosetspace.com" website excerpt at http://www.ineedclosetspace.com/details.htm (last accessed on or about Apr. 15, 2011); 3 pages.

*Primary Examiner* — Jonathan Liu
*Assistant Examiner* — Stanton L Krycinski
(74) *Attorney, Agent, or Firm* — Rod D. Baker

(57) ABSTRACT

There is disclosed a simple and versatile storage and shelving system. A plurality of specialized, sturdy, lightweight, integrally molded main panels (10) are provided, which may be hanged upon a hanger track (16) mounted upon a vertical wall (15). The main panels (10) are specially shaped to define shelf ledges (26) therein upon which shelves (18, 20) may be easily but securely placed. There are defined in the fronts of the panels (10) one or more wardrobe hooks (22) into which wardrobe rods (14) may be placed. Special hook bodies (53) for the wardrobe rods (14) and flange elements (44, 47) for the panel wardrobe hooks (22) promote secure engagement of the wardrobe rods (14) with respective pairs of panels (10) to promote the stability and security of a completely installed system. Auxiliary panels (80) may be removably connected to the bottoms of main panels (10) to increase versatility of a given system by permitting the additional of more shelves (18, 20) or drawers (20).

12 Claims, 11 Drawing Sheets

(56) References Cited

U.S. PATENT DOCUMENTS

| | | | | | |
|---|---|---|---|---|---|
| 4,596,195 | A | * | 6/1986 | Wenger | 108/31 |
| 4,664,265 | A | * | 5/1987 | George, Jr. | 211/41.17 |
| 4,728,158 | A | * | 3/1988 | D'Elia et al. | 312/108 |
| 4,819,814 | A | | 4/1989 | Fogelgren | |
| 4,995,323 | A | | 2/1991 | Kellems et al. | |
| D329,157 | S | * | 9/1992 | Santucci | D6/511 |
| 5,221,013 | A | * | 6/1993 | Santucci | 211/153 |
| 5,222,611 | A | | 6/1993 | Wood et al. | |
| 5,421,646 | A | * | 6/1995 | McNamara et al. | 312/205 |
| 5,582,306 | A | | 12/1996 | Balter et al. | |
| 5,702,010 | A | * | 12/1997 | Liang | 211/105.1 |
| 5,725,110 | A | | 3/1998 | Kluge et al. | |
| 5,752,610 | A | | 5/1998 | Remmers | |
| 5,819,958 | A | * | 10/1998 | Dement | 211/90.01 |
| 6,062,401 | A | * | 5/2000 | Hall et al. | 211/187 |
| 6,079,803 | A | | 6/2000 | West et al. | |
| 6,216,892 | B1 | * | 4/2001 | Grandclement | 211/186 |
| 6,488,159 | B2 | * | 12/2002 | Shuen | 211/123 |
| 7,210,416 | B1 | * | 5/2007 | Grigsby, Jr. | 108/165 |
| 7,275,648 | B2 | * | 10/2007 | Segovia, Jr. | 211/134 |
| 7,641,060 | B2 | * | 1/2010 | Bishop et al. | 211/105.1 |
| 7,665,619 | B2 | * | 2/2010 | Mangano | 211/187 |
| 7,686,173 | B2 | * | 3/2010 | Robinson et al. | 211/190 |
| 7,832,361 | B2 | * | 11/2010 | Stevens | 119/706 |
| 7,914,091 | B1 | * | 3/2011 | Joyce | 312/263 |
| 7,984,815 | B2 | * | 7/2011 | Lynch | 211/186 |
| 2006/0169659 | A1 | * | 8/2006 | Robinson et al. | 211/187 |
| 2006/0243688 | A1 | * | 11/2006 | Gilcrest et al. | 211/87.01 |
| 2007/0044692 | A1 | * | 3/2007 | Zimmer | 108/180 |
| 2007/0170134 | A1 | * | 7/2007 | Bishop et al. | 211/105.1 |
| 2008/0023427 | A1 | * | 1/2008 | Mangano | 211/187 |
| 2008/0237162 | A1 | * | 10/2008 | Lynch | 211/90.01 |
| 2008/0308515 | A1 | * | 12/2008 | Lange et al. | 211/134 |
| 2009/0079304 | A1 | | 3/2009 | Price et al. | |
| 2010/0000449 | A1 | | 1/2010 | Botkin | |
| 2010/0116762 | A1 | * | 5/2010 | Piersant et al. | 211/90.01 |
| 2011/0025180 | A1 | * | 2/2011 | Ilich et al. | 312/237 |

* cited by examiner

UNIVERSAL STORAGE AND SHELVING SYSTEM

CROSS-REFERENCE TO RELATED APPLICATIONS

This application claims the benefit of the filing of U.S. Provisional Patent Application Ser. No. 61/343,742, entitled "Universal Storage and Shelving System," filed on May 3, 2010, and the entire specification thereof is incorporated herein by reference.

BACKGROUND OF THE INVENTION

1. Field of the Invention (Technical Field)

The present invention relates to shelf storage, particularly to shelving systems for installation into spaces in residential homes, apartments, or other buildings, and specifically to a shelving and storage system that is lightweight yet durable, and which is simple and easily installed.

2. Background Art

Built-in shelves have been commonplace for centuries. In recent decades, there has been an increase in popularity of modular-type shelving systems, devised for purchase at retail home-improvement and hardware stores for installation by the do-it-yourself person, including homeowners and small-business persons. However, many such systems are heavy and bulky even when unassembled and packaged for sale, making it difficult for a typical person to transport the system from the point of purchase to another location for installation. Also, many known systems are of limited versatility and/or are complicated to install, particularly if power tools are required.

Many commonly encountered do-it-yourself shelf systems are fabricated from dense "particle board" composites, which are quite heavy when packaged for sale. Also known are systems using coated wire shelving which may be adapted to a particular closet by the user. Often, the wire shelving is cut to fit within the closet. The installation of wire shelving frequently involves the drilling of many holes in the wall(s). Specialized small clips often must be attached the wall using screws inserted into the pre-drilled holes. Special clips or fasteners also may be required to interconnect the various elements of the system. The rough edges of the cut wires, if not properly covered, can snag and ruin clothing.

Also, many known modular or simple shelving systems require that the ends of the shelves be attached to supporting surfaces (e.g., the "side walls" of a closet) perpendicular to the main supporting surface (e.g., the "back wall" of a closet), and thus are not suited for use on a single open wall, such as the wall of a laundry or bed room. This requirement that there be three walls (a back wall and two parallel "side" walls perpendicular to the back wall) for mounting a shelving system is even more frequently imposed if it is desired also to have horizontal clothes rods in conjunction with the shelves; in many known systems including clothes hanger rods, each end of a clothes rod must be securely fastened to a perpendicular side wall.

Other shelving systems known in the art require that support be provided to the system from the floor. Thus, many systems have base components that must be placed on the floor, or have vertical poles at the front of the system which extend to the floor to stabilize the system. This is undesirable in circumstances where there is to be other item(s) (e.g., a small bureau, clothes washer/dryer, etc.) situated on the floor beneath the shelving system.

Some known systems are flimsy, and offer insufficient structural integrity to support significant loads.

But perhaps the largest drawback to conventional shelving systems is that they tend to be difficult to install because they feature many small parts that must be identified, organized, and kept track of during installation. Sometimes many or specialized tools are required. The typical homeowner or small businessperson without prior experience with a particular system can be baffled or frustrated by installation.

Thus, there remains an unmet need for a do-it-yourself shelving system, for use by ordinary persons such as homeowners and landlords, which is easy and intuitive to install, employs a minimal number of small or specialized parts, and which yet is versatile and sturdy. A reliable and strong shelving system that also does not depend on floor support also is needed. Further, there is a need for a shelving system that in the un-assembled state is comparatively lightweight and compact so that it is relatively easy for the homeowner or other individual to transport from the point of purchase to the point of installation. Also, a lightweight modular shelving system is more affordably shipped and stocked by wholesalers and retailers. Against the foregoing background, the present invention was developed.

SUMMARY OF THE INVENTION (DISCLOSURE OF THE INVENTION)

There is disclosed hereby an innovative shelving system. The system is well-suited for installation in closets, pantries, and other enclosed spaces, but is not limited to such installation locations. The system according to this disclosure may be installed with ease upon practically any wall in a residence or commercial establishment. Notably, it is not a requirement for installation of the system that there be sidewalls, such as the side walls of a closet, at the ends of the shelves upon which to secure the ends of the system shelves. The disclosed system is modular, and simple to use and install. It is devised to be lightweight to transport prior to assembly, yet reliable and attractive after installation. The apparatus according to this disclosure potentially may be installed by a single user, using simple tools. It is adaptable for installation at a length selected by the user, and thus is readily adapted for installation in enclosed spaces (such as closets) of different widths, and is versatile to permit a variety of shelf and/or wardrobe hanger rod configurations as may be selected by the user.

One embodiment of the system according to this disclosure has 29 parts that weigh less than all conventional aftermarket-type shelving systems. The kit provided weighs, for example, only about 20 kg. An advantage thus is that the unassembled kit for the system potentially may be carried from within a retail store point of purchase to a purchaser's motor vehicle in the parking lot, by a single person with little or no assistance. The installed system is engineered to carry total loads of up to, for example, about 820 kg.

There is disclosed a simple and versatile storage and shelving system. A plurality of specialized, sturdy, lightweight, integrally molded main panels are provided, which may be hung upon a hanger track mounted upon a vertical wall. The main panels are specially shaped to define shelf ledges therein upon which shelves may be easily but securely placed. There are defined in the fronts of the panels one or more wardrobe hooks into which wardrobe rods may be placed. Special hook bodies for the wardrobe rods and flange elements for the panel wardrobe hooks promote secure engagement of the wardrobe rods with respective pairs of panels to promote the stability and security of a completely installed system. Auxiliary panels may be removably connected to the bottoms of main panels to increase versatility of a given system by permitting the additional of more shelves or drawers.

Most of the components are composed of either lightweight, impact-resistant, polycarbonate plastic or ABS plastic, and are devised to be affordably manufactured and simply assembled and installed. The system features at least two, preferably a plurality, of vertical panel components which are mounted onto a wall. The panels form the "foundation" of the versatile system. The panels have wardrobe rod hooks to receive and support wardrobe rods, as well as narrow ledges upon which the ends of shelf elements rest. In one possible and example embodiment employing four modular closet panels, the wardrobe rods can hang clothes in twelve different areas and the shelves can also be situated in twelve different locations. Each modular panel member is mounted to a wall (for example the back wall of a closet or pantry) by means of a J-shaped hanger track running horizontally along the wall. The hanger track engages with a complementary hook on the top back of each panel. Also, there is provided an aperture flange at the bottom of each panel to permit the bottom of each panel to be secured to the wall by means of a conventional drywall screw. The panels are advantageously bilaterally symmetrical and universal, so that it does not matter which side of a panel faces right or left in installation, nor does it matter which panel is placed at a side or end, versus in the middle, of the installation space or location.

A primary object of the present invention is to provide a lightweight modular shelving system, sufficiently lightweight so to be carried in its unassembled state by a single person.

Primary advantages of the present system are that it is simple to install, durable, and relatively affordable.

Other objects, features, and characteristics and further scope of applicability of the present invention, as well as the methods of use and functions of the various components of the structure, and the combination of parts and economies of manufacture will become more apparent upon a consideration of the detailed description that follows, and the appended claims with reference to the accompanying drawings, all of which form a part of this specification wherein like reference numerals designate corresponding parts in the various figures.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating preferred embodiments of the invention, and are not to be construed as limiting the invention. Further, all dimensions seen in the drawings are exemplary and not limiting of the scope of the invention. In the drawings.

Like numbers refer to like elements throughout the several drawings and views; the various views are not necessarily to scale relative to one another.

Figure 1:
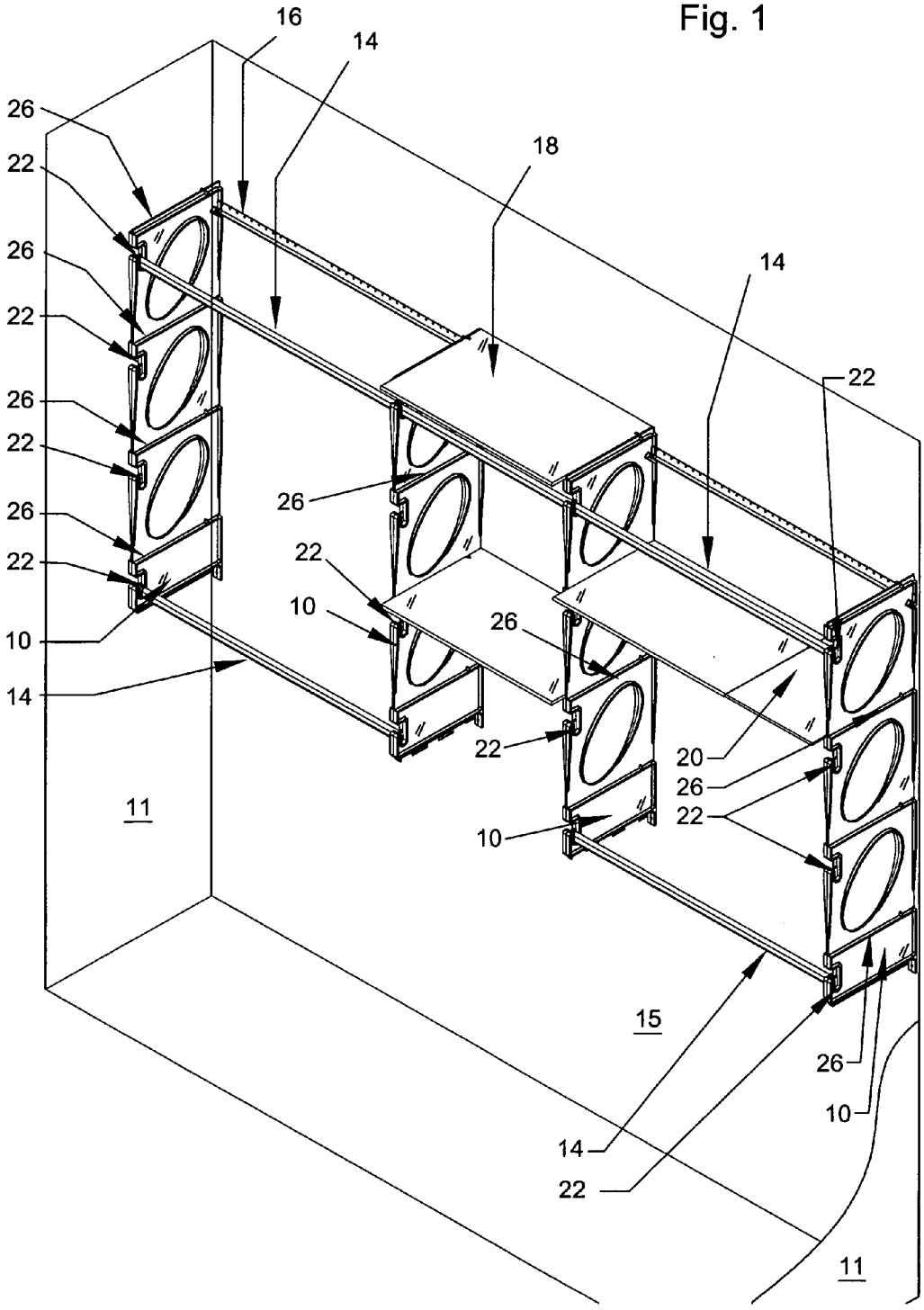
FIG. 1 is a perspective front view, from above, of an exemplary embodiment of a shelving system according to the present disclosure, illustrating the system installed relative to the walls of a closet.

DESCRIPTION OF THE PREFERRED EMBODIMENTS (BEST MODES FOR CARRYING OUT THE INVENTION)

In this disclosure, reference is made to the accompanying drawings which form a part hereof, and which illustrate specific embodiments and methods by which the invention may be practiced. These embodiments are described herein to enable those skilled in the art to practice the invention, but is shall be evident that other embodiments may be used and that the configuration and details of structure may be modified without departing from the spirit and scope of the present invention. Therefore, the following detailed description must not be construed as limiting. The scope of the present invention is defined by the appended claims.

The elements and components of the disclosed shelving and storage apparatus and system are adjustably arranged for adaptation to various storage and organizational needs and spaces, including but not limited to storage areas including closets, rooms in commercial establishments, and rooms in residential dwellings, including basements, garages, kitchen pantries, laundry rooms, garages, and the like. The shelving system can have many variations of its components including various combinations of the vertical panels, shelves, and wardrobe rods, such as configurations and installations where a single component is provided with other components, or configurations where multiple components are provided.

There is disclosed hereby an innovative shelving system for installation on a single open wall, as well as in more enclosed storage spaces such as closets and pantries. It is modular, and simple to use and install. The apparatus system is devised to be lightweight to transport prior to assembly, yet reliable and attractive after installation. The apparatus according to this disclosure potentially may be installed by a single user, using a minimal number of simple tools. The system according to this disclosure may be mounted on practically any vertical wall. It is adaptable for installation in closets of different widths, and is versatile to permit a variety of shelf and wardrobe hanger rod configurations as may be selected by the user. Nevertheless, it shall be understood that system installation is not limited to installation within enclosed or confined spaces such as closets or pantries. Desirable installation may be upon a wall within an open wall or garage or the like.

For example, a kit according to the system according to this disclosure has 29 parts that weigh less than all conventional aftermarket-type closet shelving systems. The kit provided weighs, for example, only about 20 kg. An advantage thus is that the unassembled kit for the system potentially may be carried from within a retail store point of purchase to a purchaser's motor vehicle in the parking lot, by a single person with little or no assistance. The installed system is engineered to carry total loads of up to, for example, about 820 kg.

Most of the components are composed of either lightweight, impact-resistant, polycarbonate plastic or ABS plastic, and are devised to be affordably manufactured and simply assembled and installed. The system features at least two, preferably a plurality, of vertical panel components which are mounted into a wall. The modular vertical panels form the "foundation" of the versatile system. The vertical panels have wardrobe rod hooks to receive and support wardrobe rods, as well as narrow (e.g. approximately 1.0 cm) ledges upon which the ends of shelf elements rest. In one embodiment employing four vertical panels, the wardrobe rods can hang clothes in twelve different areas and the shelves can also be situated in twelve different locations. Each vertical panel member is mounted to the wall by means of a J-track hanger mounted horizontally along the wall, which engages with a complementary hook on the top back of each panel. Also, there is provided an aperture flange at the bottom of each panel to permit the bottom of each panel to be secured to the wall by means of a conventional drywall screw. Advantageously, the panels are bilaterally symmetrical and universal, so that it does not matter which side of a panel faces right or left in the installation, nor does it matter which panel is placed at a side versus in the middle of an installed system.

In the disclosure that follows, the terms "up" and "down" have their ordinary meaning in relation to gravity. "Right" and "left," "top" and "bottom," and "back" (or "rear") and "front" may be best understood in the reference of drawing FIG. 1, showing a perspective front view of an example of an installed system upon a back wall 15 and between a right side wall 11 at the right side of the figure and a left side wall 11 at the left side of the figure, with a floor seen between the bottoms of the side walls. "Integral" or "integrally" means a complete unit or unitary whole, not composed of separate parts fastened together.

FIG. 1 shows the apparatus according to the present disclosure installed within a closet. Again, it is understood that the apparatus is well-suited for use within a closet, but is not so limited. In a preferred embodiment of the system, four vertical panels 10 are mounted within the space, substantially parallel to each other. In the closet installation shown, the panels 10 are likewise parallel to the closet side walls 11. An advantage of the present system, however, is that closet sidewalls 11 are not required to be present to support the system. In the embodiment illustrated, four vertical panels 10 are shown; it shall be recognized those skilled in the art, however, that the number of panels 10 can be varied to adapt the system to installation spaces or locations of different widths and to permit the user to select a particular system configuration suited to her personal preference. Thus, it is possible for a shelving system installed according to the present disclosure to feature as few as two, and perhaps as many as six or more vertical panel members 10; a plurality of panels may be installed serially in parallel in numbers to suit the width of the desired installation, whether it be upon a single wall of a living room, garage, commercial or professional office, work or sales room, or within a more confined space such as a closet according to the user's own customized plan or choice.

The vertical panels are fabricated from a lightweight rigid plastic, for preferred example, a molded lightweight polycarbonate plastic, and may be clear, frosted, or colored, with a pleasant aesthetic finish. Polycarbonate main panels are preferred, as they are readily molded, and thermoformed in to strong, yet aesthetic configurations. Further, panels of molded polycarbonate are strong, yet lightweight (e.g., approximately 1.20-1.22 g/cm$^3$). Panels 10 according to the present disclosure may be manufactured by extrusion into sheets, followed by further fabrication into other shapes using thermoforming or other secondary fabrication techniques, such as by bending and routing. Alternatively, as known in the art of plastics fabrication, polycarbonate also may be manipulated by injection molding.

Referring still to the embodiment of FIG. 1 it is seen that two outside panels 10 are mounted against the closet side walls 11, while two (or more) inside panels are situated parallel between the outside panels. The outside panels 10, however, need not be attached to the closet side walls 11, and installation of the system progresses the same regardless whether any sidewalls 11 are present. The spacing distance between the inside panels may be a predetermined fixed distance to accommodate shelve(s) 18 that are non-adjustable in size; alternatively, it is possible without departing from the scope of the invention for the relative separation distances between the various panels 10 to be independently selected by the user. The distances between the inside panels 10 and the outside panels, may be selectable by the user to accommodate her particular system configuration plan. Each of the vertical panels 10 is installed so that its wardrobe rod hooks 22 face forward, toward the user, as suggested by FIG. 1.

All the vertical panels 10 in a given kit according to the system are identical, thus promoting facile installation of the system. Further, the panels 10 are bilaterally symmetrical, the right and left hand sides of each panel being substantially identical (except to be reverse or "mirror" images of each other). This also promotes easy installation, as the user merely installs all panels 10 with their respective front edges facing outward toward the user, but in any order; no particular panel 10 need be installed first, or last, etc. Further, the integrated shelving ledges and tapered frame members (to be further described) on each panel 10 indicate intuitively to the user the "top" and "bottom" of each panel.

Figure 2A:
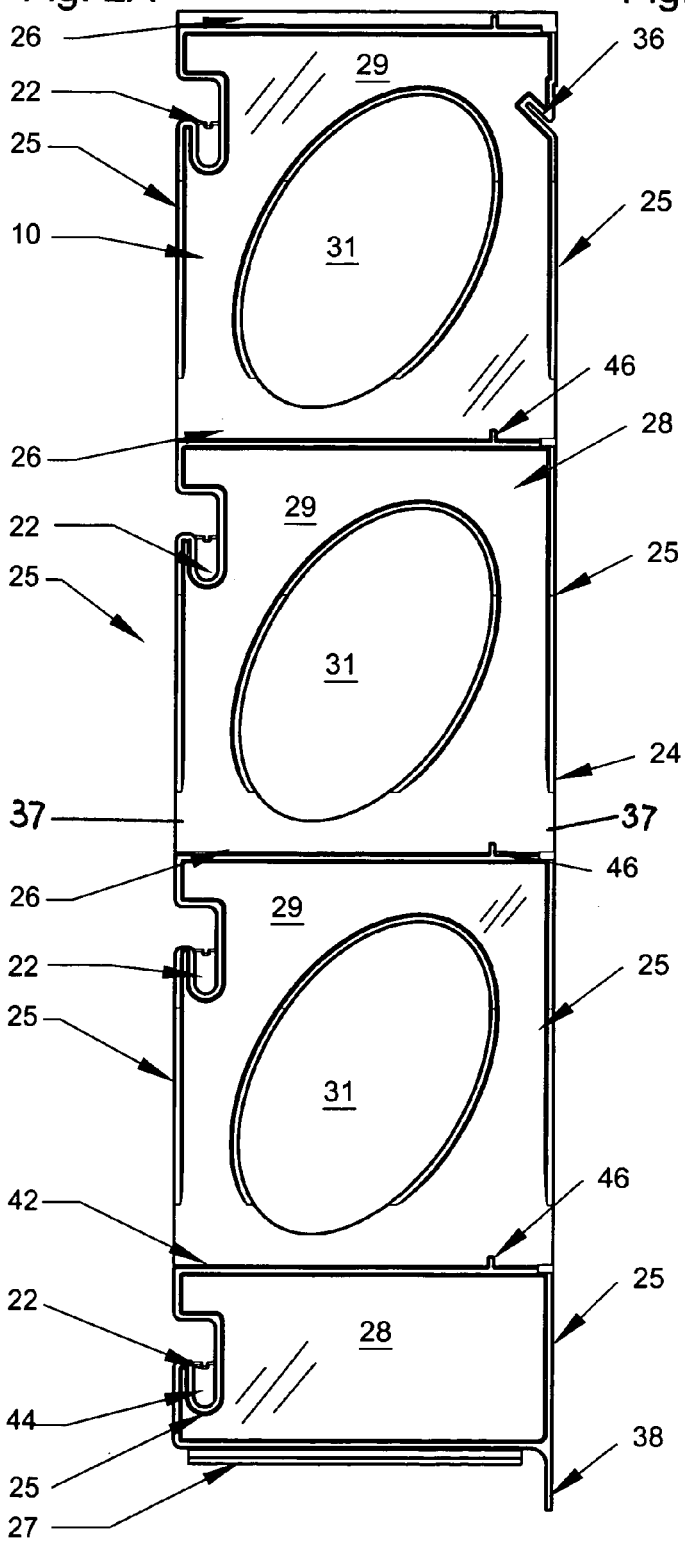
FIG. 2A is a right side view of a main panel member usable in the system according to the present disclosure.
Figure 2B:
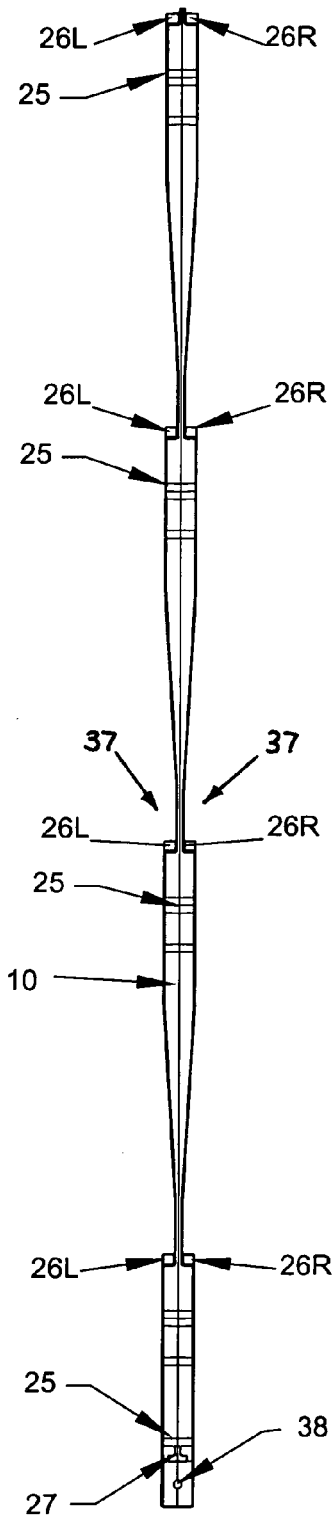
FIG. 2B is a front view of the panel seen in FIG. 2A.

The main panel 10 seen in FIGS. 2A and 2B is exemplary and preferred, but not limiting. It is immediately appreciated by one skilled in the art that the panels 10 are modular, and can be fabricated in a variety of sizes. Referring to the embodiment of FIGS. 2A-B, the panel 10 may be, for example only, between about 100 cm and 115 cm high, and between about 30 cm and about 40 cm deep front-to-back). The maximum thickness of a panel 10 may be, again by way of example, between approximately 2.5 cm and approximately 4.0 cm.

The panel embodiment seen in the figures is configured to define three integrated cells or sections, each section being bounded on the top and the bottom by a pair of shelf ledges 26, and on the front and back by the frame flanges 25. There also is shown the optional or preferred bottom section 28 depending from the bottom of the lowermost cell. The sections or cells in the preferred embodiment each has an aesthetic, weight-reducing aperture 31 defined though its web 29.

It is to be understood that a main panel 10 according to the present disclosure is not limited to having three main cells or "sections" as described immediately above in reference to FIG. 2A. An advantage of the invention is its modularity. Accordingly, a single main panel 10 may have as few as one section having a web 29 bound by a shelf ledge above and a shelf ledge below, and a back and a front, the front having a single rod hook 22 for the panel. Of course, every panel, regardless of the number of cells or sections it manifests, features a track hook notch 36 in the back of its upper-most cell or section. Another panel accordingly can be relatively larger, in vertical extent, by the provision of one or more essentially duplicate sections or cells integrally formed with, and depending serially down from, the top-most section having the hook notch 36. A given panel 10 may have therefore and according to the invention, one or more, up to (for example five or six) panel sections such as the three sections seen in FIGS. 2A-B. A bottom section 28 optionally but preferably is provide as the bottom-most section in any panel 10, as seen in the drawing figures.

The panels 10 are attached to the wall 15 (such as, but not necessarily, a back wall of a closet) by means of a hanger track 16 secured upon the wall. The hanger track 16 shall be described further hereinafter. An upper portion of each vertical panel 10 engages with the hanger track 16. Also, an aperture preferably is provided at a bottom portion of each panel 10, through which a drywall screw or the like can be advanced to secure the bottom of each panel to the wall 15.

Continued reference to FIG. 1 shows that a selected plurality of wardrobe rods 14 are placed into selected associated pairs of rod hooks 22 provided on the front edges of the panels 10. The user can choose the number (four illustrated in FIG. 1) of wardrobe rods 14 to utilize in a particular system installation, and can engage them at various different positions upon the panels 10. In the embodiment seen in FIG. 1, there are sixteen rod hooks 22 offering twelve associated pairs of hooks, permitting the user to choose a variety of different numbers and height positions of wardrobe rods 14 for installation in the system.

An advantage of the system is that the wardrobe hooks 22 are defined into the fronts of the panels 10, that is, the hooks are offset rearward into the web portion 29 of the panel 10, rather than extending out frontward from the front of the panel. This configuration of the wardrobe hooks 22 not only is more aesthetic, but less obtrusive without sacrificing functionality. Further, the system is sturdier with such recessed hooks 22. Conventional clothes rod hooks that project a substantial distance out from the front of a shelf act as undesirable lever arms. When a clothes rod is disposed on such conventional forward-thrusting rod hooks, and a rod placed thereon and loaded with many garments, the collective weight of the garments is leveraged by and through the hook to generate a substantial upward force upon the shelf; further, the weight of the garments typically is relatively concentrated at a point cantilevered from the front of the shelf, a condition which may promote failure of the hook. In the presently disclosed system, in contrast, the collective weight of the garments upon a wardrobe rod 14 is much better distributed and dissipated, as it is imposed not upon a cantilever but instead downwardly upon the complete body (including the web 29 between front and back frame flanges 25) of a panel 10. The advantage is doubled by the use of two panels 10 used to support a given wardrobe rod 14.

Also, a plurality of shelf components may be selectively disposed between and upon the panels 10. Seen in FIG. 1 is a fixed-size shelf 18 situated at a top-most position between a pair of inside shelves 10, and an adjustable shelf assembly 20 placed at an intermediate height position between an inside panel and a left-side outside panel 10. There also is shown a second fixed-size shelf 18 placed below the upper-most first one, at one of two intermediate-height positions defined between the two inside panels. As shall be described further hereinafter, each vertical panel 10 has integrally molded therein, on both its left and its right side, a plurality of shelf ledges. In the embodiment depicted in FIG. 1, each panel 10 features four ledges on each side of the panel. Each end of a shelf 18, 20, may be rested upon a corresponding shelf ledge on a respective panel 10 to support the self 18 or 20 in horizontal position. In the embodiment seen in FIG. 1, there are twelve pairs of associated shelf ledges on four panels 10, permitting the user to choose a variety of different numbers and height positions of shelf components 18 and/or 20 for installation in the system. (In FIG. 1, the shelf ledges on the outside sides or faces of the two outside panels 10 are not in use.)

Combined reference is made to FIGS. 2A and 2B, illustrating in more detail a vertical panel 10 according to the present system. Description of one vertical panel 10 serves substantially to describe all the panels (e.g., each of panels 10 seen in FIG. 1), as all the panels preferably are molded to be substantially identical. This is one of the advantages of the present apparatus; the panels of a given kit or system preferably are all the same size and shape, and preferably are bilaterally symmetrical about their principal definitional plane. Thus, FIG. 2A shows the right side of an exemplary panel 10; the left side of the panel 10 seen in FIG. 2A is the same as the right side (except being a reversed "mirror image"). For this reason, any particular panel 10 can be situated at any selected lateral location within a particular installation. Any panel 10 can serve as an "inside" panel in an installation having three or more panels, and any panel can function as the "outside" or end panel in any installation. Also, for example, either side of a panel 10 can be placed against a closet side wall 11.

This very desirable universality of the panels 10 is promoted by their symmetry. FIG. 2B shows a front edge view of an embodiment of a panel 10. An imaginary central plane (perpendicular to the plane of the paper) is perceived in FIG. 2B, and runs from the top to the bottom of the panel to define the panel's formational plane of symmetry. Because the left side of the panel is the same as the right side, any panel can be used in any location in the system. The need to place panels in any particular order (right to left) along the wall is eliminated. The user intuitively places the front of the panel forward facing him, and readily senses "up" from "down" on the panel.

In one preferred embodiment, a panel 10 has a generally rectangular exterior shape when viewed from the side as seen in FIG. 2A. A panel 10 preferably has a generally planar, flat back 24 that can be placed flush against the wall 15 upon which the panel is installed. The front edge of a panel also typically (but not necessarily) is generally flat and rectilinear, except where periodically interrupted by the concave nocks associated with the wardrobe rod hooks 22 as seen in FIG. 2A. The back, front, and bottom edges, and optionally the top edge, of the panel 10 preferably feature integrally molded, thickened frame flanges 25 to lend additional stiffness and structural integrity and stability to the overall panel. The top of the panel 10 is mostly defined (and rigidized somewhat) by the thickness provided by the presence of a pair of horizontal, laterally projecting shelf ledges 26 to be further described. Each vertical panel 10 has at least two, and more preferably four or six, and most preferably eight, horizontal shelf ledges 26 molded integrally with the panel 10. The shelf ledges 26 occur in pairs, at selected height positions on the panel 10, with ledges from a given pair disposed on opposite sides of the panel.

The panel 10 has a central web 29 that extends generally throughout its height and front-to-back depth, to provide load-bearing strength to the panel. As seen in FIG. 2A, the web 29 may define therein one or more apertures 31 therethrough, of comparatively large size and at selected positions, which apertures 31 reduce the weight of the panel without unduly compromising its structural stability. The oval apertures 31 as shown in the drawing figures also are aesthetic, and offer additional locations on a panel where a user my drape or hang a lightweight item (e.g. a necktie or small bath towel) in an installed system.

Further understanding of the shelf ledges 26 is had with combined reference to FIGS. 1, 2A and 2B. FIG. 2B is a front view of the panel 10 seen in FIG. 2A. In the embodiment shown, the panel 10 has eight shelf ledges 26 molded in the sides thereof; four associated pairs, approximately equispaced vertically at four heights above the bottom of the panel. There are four ledges 26L provided on the left side of the panel 10, and four ledges 26L provided on the right side of the panel. Each ledge 26 extends laterally outward from the web 29 a suitable distance (e.g., between approximately 0.5 cm and approximately 2.0 cm) to provide a substantial, reliable, supporting surface upon which the end of a shelf element (18, 20) can be laid.

Continuing reference to FIGS. 1, 2A, and 2B illustrates that each vertical reinforcing frame flange 25 is tapered downward (as viewed from the front or back), decreasing progressively in lateral extent as it descends from a pair of shelf ledges above the flange and approaches ledges below the frame flange. Thus, as best seen in FIG. 2B, at their respective tops, the stabilizing frame flanges 25 have their maximum lateral extents, corresponding approximately to the width of the pair of shelf ledges (left-side ledge 26L), (right-side ledge 26R) at the top of the flange. The width of each flange 25 decreases toward the bottom of the flange; at the bottom of a vertical flange, its width effectively equals the lateral thickness of the corresponding web 29 as the flange 29 essentially "disappears" into the web 29 just above a second, lower pair of shelf ledges 26L, 26R. This downward tapering of flanges 25 on the front and back of each section of a panel 10 decreases each flange's lateral extent as the flange descends from an upper shelf ledge to approach a lower shelf ledge below the frame flange; thus there is a vertical gap 37 defined between the bottom of a flange 25 and a lower shelf ledge. The absence of laterally projecting frame flanges 25, in the vicinity immediately above the ledges 26, permits the end of a shelf 18 or 20 to be lowered into place upon a particular ledge 26 without interference from a laterally projecting frame 25.

The frame flanges 25 thus reinforce the panel, but do not interfere with its use. The gradual taper of those flanges located at the back and front of each panel results in the bottom of each vertical flange is a modest distance above the shelf ledge 26R or 26L situated there below, providing a vertical gap between the flange and the shelf ledge to facilitate the placement of an end of a shelf 18 or 20 upon the ledge.

Figure 4A:
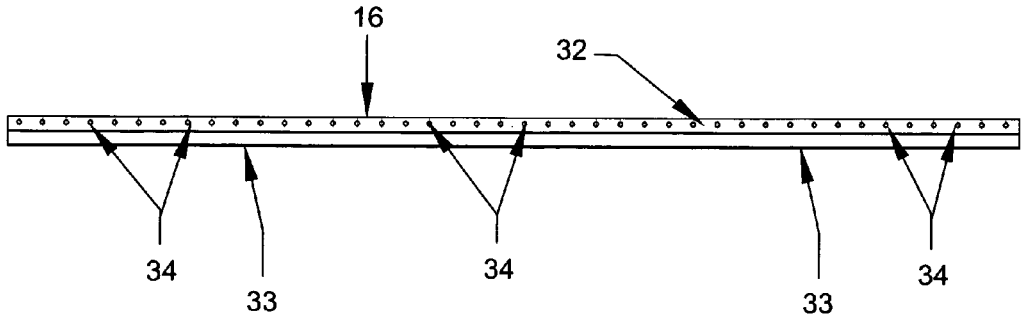
FIG. 4A is a front view of a hanger track component of the system according to the present disclosure.
Figure 4B:
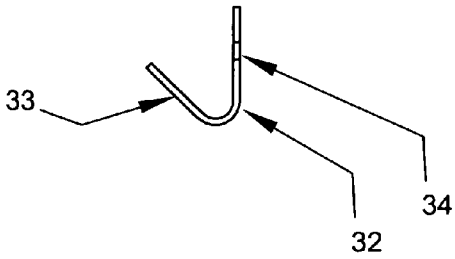
FIG. 4B is an enlarged side view of the hanger track seen in FIG. 4A.

FIGS. 4A and 4B illustrate a version of a hanger track 16 according to the presently disclosed system. The hanger track 16 may be fabricated from, for example, fifteen gauge steel, although other suitably stiff, durable compositions may also be employed. The hang track 16 is mounted, as for example with drywall screws (with mounting toggles, and/or into wall studs) horizontally at a user-selected height across the wall 15 as seen in FIG. 1. FIG. 4A shows that the shank 32 of the hanger track 26 is provided with a series of mounting holes 34 uniformly distributed along the length of the track. The holes 34 are sized to provide passage of ordinary drywall screws or like fasteners for mounting the track 26 upon the wall. Adjacent holes 34 are separated by a modest spacing distance, so to maximize the opportunity for fasteners disposed through a given hole to be screwed into a supporting wall stud beneath drywall of the wall 15. The hanger track 16 may initially be about 120 cm long, for illustrative example, but may be cut to a user-selected length to suit the particular installation configuration, or to fit the width dimension of a pantry or closet. The hole pattern of holes 34 may be set at approximately 2.5 cm spacing to promote the track mounting screws or other fasteners to be locatable so as to be driven into a wall stud.

As seen in FIGS. 4A and 4B, particularly FIG. 4B, the hanger track 16 is bent to define a J-shaped hook, in end profile, preferably throughout its axial length. The hook portion 33 is engageable into a complementary hook notch 36 near the top of the back edge 24 of each panel 10.

Reference is returned to FIG. 2A. The back edge 24 of each panel 10 is provided, near the top of the panel, with an indented hook notch 36 defined into the panel. The shape and size of the interior contours of the hook notch 36 are substantially complementary with the contours of the hook 33 portion of the hanger track 16. The panel's hook notch 36 preferably is reinforced on either lateral side by frame flange elements 25 continued from the back 24 of the panel. The flange 25 around the hook notch 36 is sized to have a contour generally corresponding to the generally J-shaped configuration of the hook notch 36 itself, as seen in the upper portion of FIG. 2A. Thus, when a panel 10 is lifted into place, the user permits the hook 33 of the previously installed hanger track 16 to engage securely (but removably, as by gravity) into the panel's hook notch 36. With the hook notch 36 engaged over the hook 33, the panel 10 hangs reliably from the hanger track 16 which is fixed to the wall 15.

FIGS. 2A and 2B also show that there is a small attaching flange 38 which depends downward from the bottom of the back 24 of each panel 10. This vertical bottom flange 38 may be penetrated by a screw aperture (FIG. 2B). To install reliably a panel 10 upon a wall 15, a drywall screw or equivalent suitable fastener (not shown) is driven through the aperture into the wall 15 (preferably into a wall stud). This preferable use of a lower fastener reduces any tendency for a panel 10 to "swing" side-to-side upon the track 16.

A useful feature of the presently disclosed system is the specialized wardrobe rod hooks 22 defined in the front of each panel 10. FIGS. 1 and 2A show that one or more wardrobe rod hooks 22 is provided, preferably by being integrally molded into the body of the panel 10.

Figure 2C:
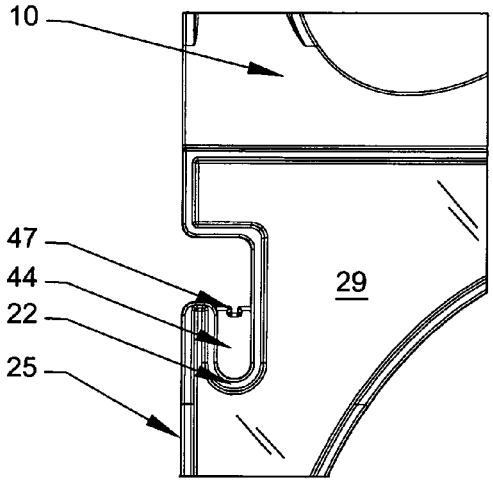
FIG. 2C is an enlarged side view of a broken-away portion of the panel seen in FIG. 2A, depicting details of the wardrobe hook feature.

FIG. 2C is an enlarged right side view of any one of the four rod hooks 22 seen in FIG. 2A. A wardrobe rod hook 22 is defined as a notch in the front edge of a panel 10 which extends down and into the web 29 of the panel. As suggested by the drawing figures, especially FIG. 2C, the interior edges of the rod notch are bounded and reinforced by correspondingly shaped and contoured thickened portions of frame flange 25, with the flange having a broader lateral extent than the adjacent web portion 29. The rod notches are heavy duty in their load-bearing capacity.

Centrally located (e.g. with respect to lateral, side-to-side, coordination) within each rod hook 22 is a vertical rod hook flange 44. The rod hook flange 44 is a comparatively thin flange integrally molded with the walls of the hook 22. As best seen in FIG. 2C, the rod hook flange 44 itself preferably but optionally defines a small notch 47 in its top edge. The small notch 47 in the rod hook flange 44 is to facilitate engagement between the flange 44 and a hook body component 50 to be further described shortly.

Figure 3A:
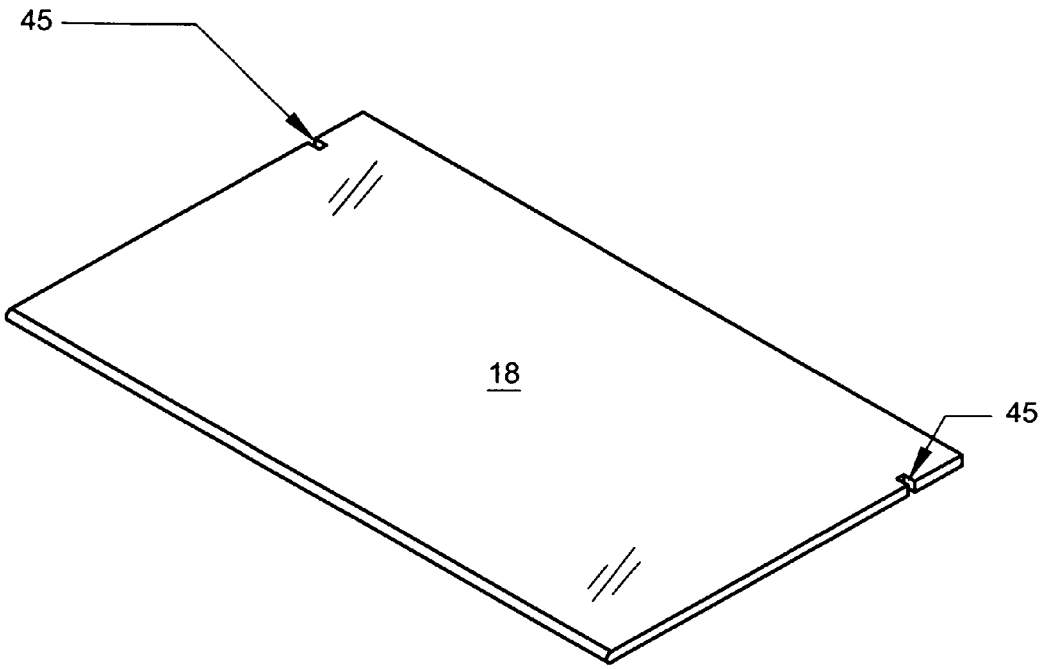
FIG. 3A is a perspective side view of a possible unitary shelf component of the system according to the present disclosure, showing a pair of lock notches on opposing sides of the shelf.
Figure 3B:
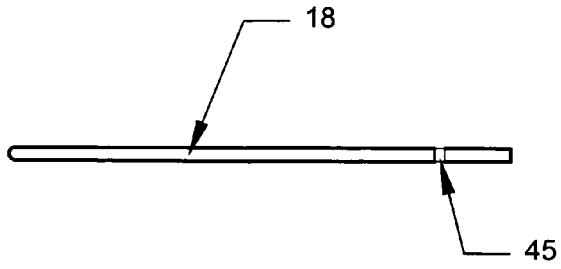
FIG. 3B is a side or end view of the shelf component seen in FIG. 3A.

FIGS. 3A and 3B show a fixed-size unitary shelf 18 usable in the system. Such unitary shelf 18 may be, for example only, about 60 cm long (end to end), 35 cm deep, and about 0.5 cm to about 2.0 cm thick. Shelves in the present system preferably are fabricated from polycarbonate. One or more unitary shelves 18 can be used in those locations in an installed system, such as the installation seen in FIG. 1, in which adjacent panels 10 (i.e., the two inside panels in FIG. 1) are installed a spaced-apart distance corresponding to the end-to-end length of a unitary shelf such as 18 in FIG. 1.

FIGS. 3A and 3B show how each unitary shelf 18 preferably has at least one locking notch 45 in each of its ends (sides) (only one notch 45 seen in FIGS. 3A-B). These locking notches are engageable with corresponding locking nubs 46 on a shelf ledge 26 to position and retain the shelf 18 in proper disposition upon and between a pair of adjacent panels 10. Locking nubs 46 (FIG. 2A) are small upward projections secured to, or preferably integrally molded with, each shelf ledge 26 on each panel 10. Thus, when a shelf, such as unitary shelf 18 is placed into position between two adjacent panels 10, with its ends resting upon a respective ledge 26 on a panel 10, a locking nub 46 engages into a correspondingly located locking notch 45 in each end of the shelf 18.

Figure 5A:
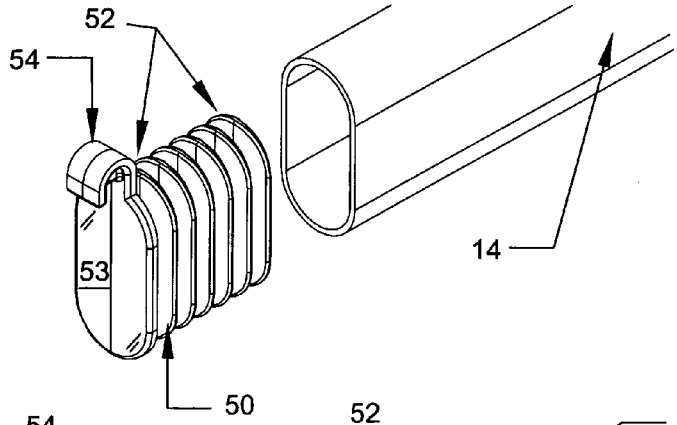
FIG. 5A is an enlarged perspective view of a wardrobe rod component of the system according to the present disclosure, and a hook body component of the system insertable into an open end of the wardrobe rod.
Figure 5B:
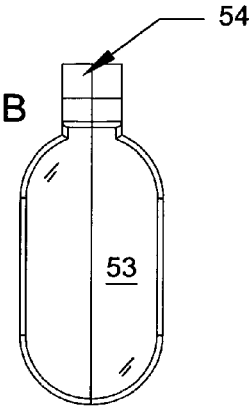
FIG. 5B is an enlarged side or end view of the hook body component seen in FIG. 5A.

A typical wardrobe rod 14 usable in connection with the present system is seen in FIG. 5A. The wardrobe rod 14 is conventional in the art, and preferably is crafted from rolled or extruded steel tube, and is hollow. As seen in FIG. 5A, it preferably manifests a sort of oval radial profile. The tube of the rod 14 preferably is readily cut to a selected desired length by means of a light-duty hacksaw or the like.

FIG. 5A also shows that a specialized hook body 50 is insertable into the hollow ends of the wardrobe rod 14. The hook body 50 is devised to permit a secure but detachable connection of each end of a wardrobe rod 14 with a corresponding wardrobe rod hook 22 on an appropriately selected panel 10.

A detailed description of the hook body 50 is supplied with reference to FIGS. 5A-E. The hook body 50 preferably is molded from ABS plastic, and preferably is integrally molded as a one-piece component. It has a central, planar beam 51 along which are situated a plurality of equal-spaced and parallel support flanges 52. The support flanges 52 are fixed in their positions along the beam 51. Each flange 52 is a thin planar element, and has a very generally ovoid shape in end view. The exterior contour defined by the perimeter of each flange 52 corresponds closely to the interior contour of the aperture in the ends of the wardrobe rod 14. Accordingly, and as suggested by FIG. 5A, the conjoined series of support flanges 52 can be inserted firmly and snugly into each open end of a wardrobe rod 14.

Figure 5C:
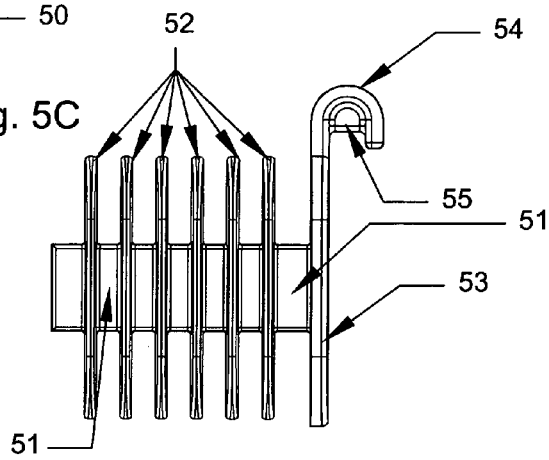
FIG. 5C is a front view of a hook body component seen in FIG. 5B.
Figure 5D:
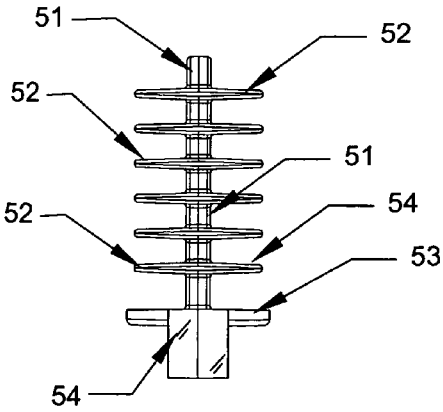
FIG. 5D is a top view of the hook body component seen in FIG. 5B.
Figure 5E:
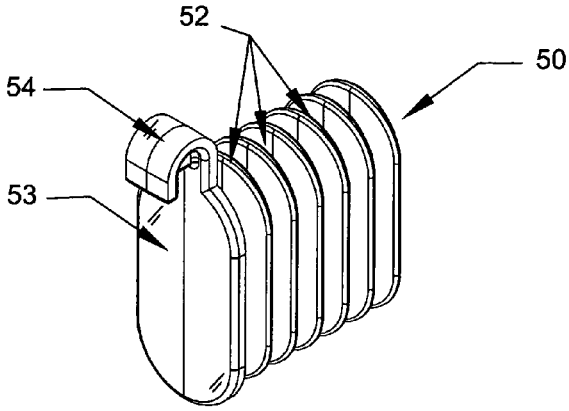
FIG. 5E is a perspective view, from above, of the hook body component seen in FIGS. 5B-5D.

The hook body 50 has an end flange 53 on an end of the beam 51. Ordinarily, when the system is assembled, a hook body 50 is frictionally engaged into each open end of each wardrobe rod 14. The insertion is complete when the end flange 53 is in flush contact, or nearly so, with the end of the tube of the rod 14. Thus, the support flanges 52 are snugly engaged within the interior of the hollow wardrobe rod 14, with the end flange 53 abutting the end of the rod. Extending from the top of each end flange 53 is a clip hook 54 generally in the shape of an inverted "J". As best seen in FIG. 5C, centrally situated in the crotch of the clip hook 54 is a thin lock web 55 molded integrally with the hook 54. Each clip hook 54, with its lock web 55, is reliably engageable with wardrobe rod hooks 22.

Figure 11A:
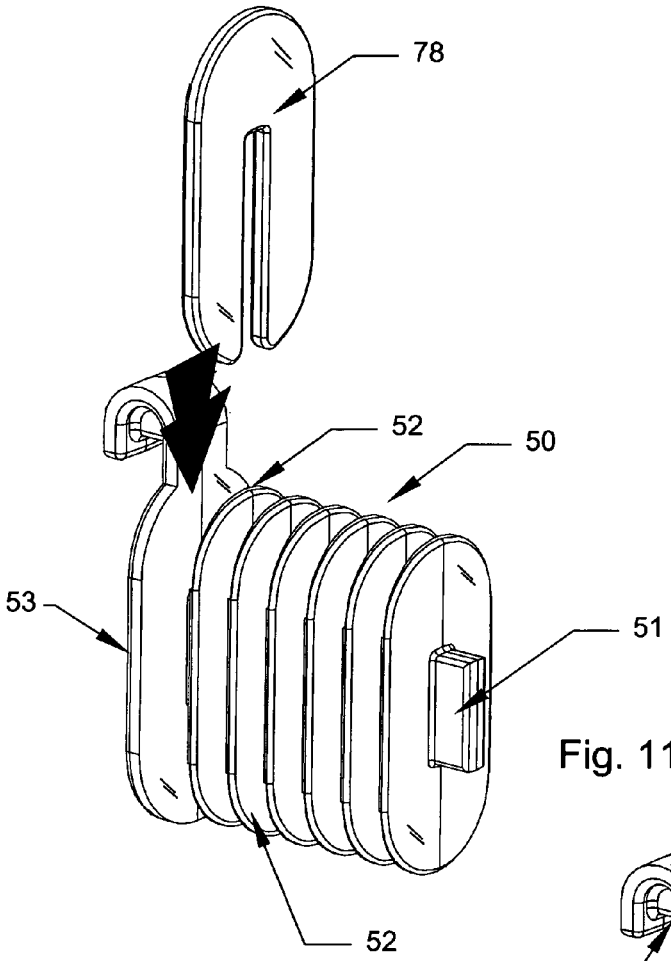
FIG. 11A is an enlarged side view of the hook body depicted in FIGS. 5A-E, showing how the spacer seen in FIGS. 6A-C is engageable therewith.
Figure 11B:
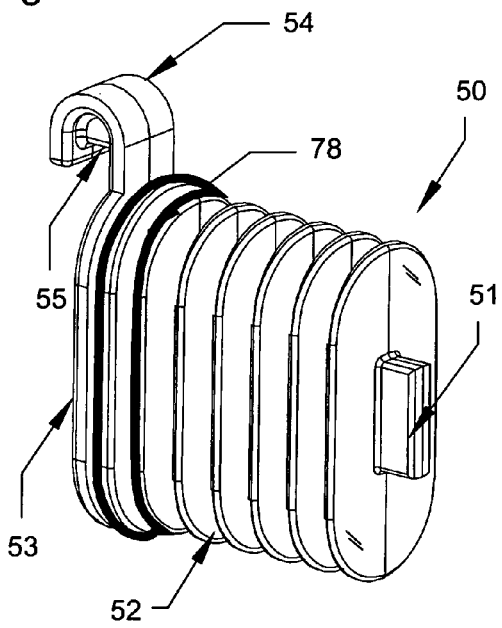
FIG. 11B is an enlarged side view, showing the spacer in place upon the hook body, which is then insertable into an open end of a wardrobe rod.

To install a wardrobe rod 14 upon and between two adjacent panels 10, the rod is cut to the appropriate length to equal as closely as possible the distance between the rod hooks 22 on the panels between which the rod will be disposed. A hook body 50 is securely inserted into each end of the wardrobe rod 14, such that the clip hook 54 of each hook body projects upward, but with its lock web 55 directed downward, as seen in FIGS. 5A and 5C. Each hook body 50 is inserted into the rod notch of a wardrobe rod hook 22 in a panel 10. It is immediately understood that two rod hooks 22 at the same height elevation in adjacent panels 10 are used to mount a particular wardrobe rod 14. The clip hook 54 of each hook body 50 is engaged downward to inter-engage with the rod hook flange 44 in the rod hook 22. Further, the lock web 55 in the clip hook 54 snaps into the small notch 47 on the top edge of the rod hook flange 44. With the clip hook 54 of each hook body 50 thus interconnected with a rod hook flange 44 of a correspondingly associated rod hook 22 in a pair of adjacent panels 10, the wardrobe rod 14 is releasably secured in horizontal place for use, as indicated in FIGS. 1 and 11A.

Significantly, the connection of the ends of a rod 14 to the respective rod hooks 22 of adjacent pairs of panels 10 stabilizes the panels by limiting their freedom of lateral (side-to-side) movement. Accordingly, and as suggested by FIG. 12A, the need to secure the outermost panels of an installed system to sidewalls (such as the end walls of a closet) is eliminated. The use of rods 14 reliably connected horizontally to and between a pair of adjacent panels 10 lends structural integrity and lateral stability to an overall system installation, permitting a system to be mounted upon a single vertical wall without the need for bracing to any other supports. The stability of a completed system installation also is enhanced by the placement of shelves 18 and/or 20 between adjacent panels 10, the reliability of the placement increased by the interlocking action between locking notches 45 in the ends of the shelves 18, 20 and the locking nubs 46 preferably defined on the shelf ledges 26.

Figure 7A:
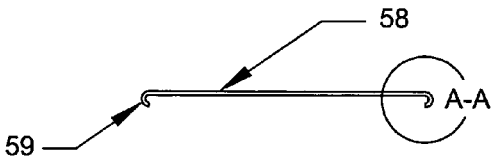
FIG. 7A is an end view of the main body of an adjustable shelf according to the system of the present disclosure.
Figure 7B:
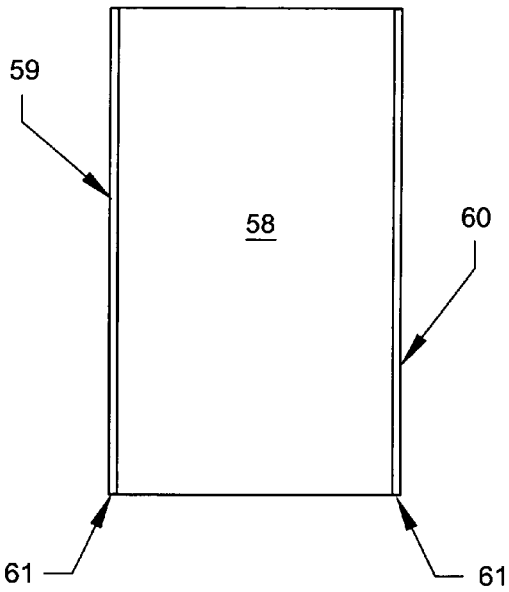
FIG. 7B is a bottom view of the adjustable shelf main body seen in FIG. 7A.
Figure 7C:
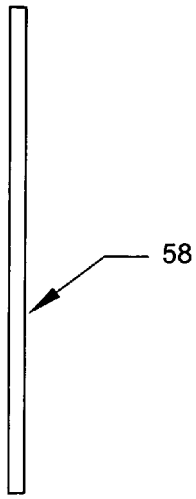
FIG. 7C is a side view of the adjustable shelf main body seen in FIG. 7B.
Figure 7D:
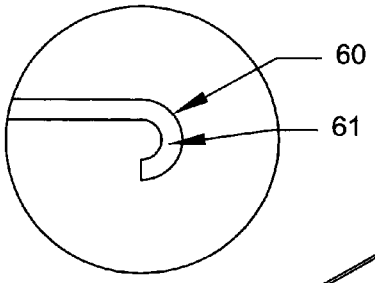
FIG. 7D is an enlarged end view of a portion A-A of the adjustable main shelf body depicted in FIG. 7A.
Figure 7E:
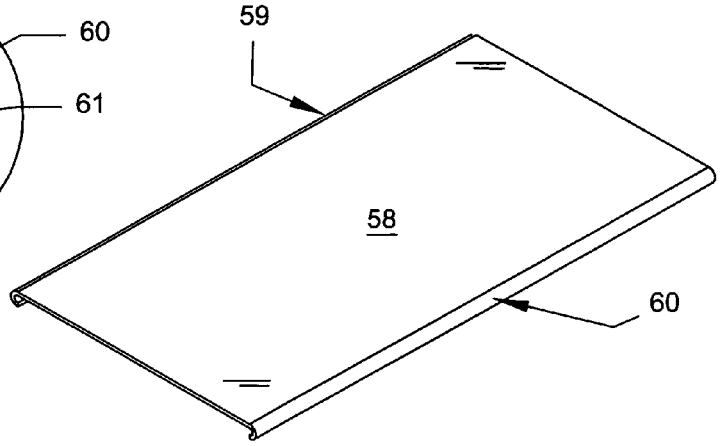
FIG. 7E is a perspective view of the adjustable main shelf body seen in FIGS. 7A-C.

The versatility of the shelving system according to this disclosure is enhanced by the use of adjustable shelf assemblies (e.g., adjustable shelf 20 in FIG. 1). The adjustable shelf assemblies 20 are depicted by combined reference to FIGS. 7A-E, 8A-E, and FIG. 9. Referring to FIGS. 7A-E, there is provided an adjustable shelf main body 58 molded in a generally rectangular shape as seen in FIGS. 7A-C and 7E. In a given system, a plurality of shelf main bodies is supplied, and the main bodies are substantially the same so that description of one describes them all. An adjustable shelf main body 58 preferably is molded from polycarbonate plastic. The adjustable main body shelf 58 is sized and shaped generally in accordance with shelving conventions, except that the front edge 59 and back edge 60 of the main body 58 each has a curled-under C-shaped lip 61 as best seen in the enlarged view of FIG. 7D. The lips 61 curl inwardly under the planar portion of the main body 58, toward the axial center of the body 58 as indicated in FIGS. 7A and 7E. These lips 61 provide for an adjustable sliding engagement between the adjustable shelf main body 58 and one or two shelf extender components 64 (FIGS. 8A-E) as will be further described.

Figure 8A:
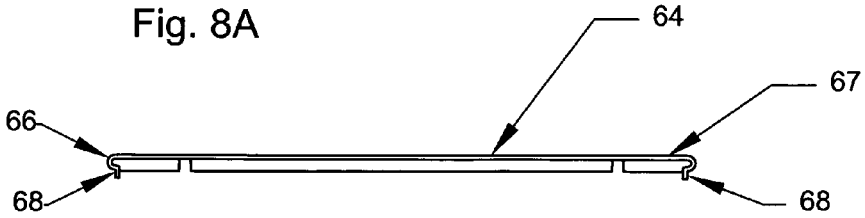
FIG. 8A is an end view of a shelf extender component usable in conjunction with the adjustable main shelf body seen in FIGS. 7A-E.

FIGS. 8A-E show a shelf extender 64, which is used in conjunction with a shelf main body 58 to provide an adjustable shelf assembly 20 in the disclosed system. Description of one shelf extender 64 describes a plurality, as they are substantially identical. A shelf extender 64 is used in sliding relation with the adjustable shelf main body 58. In the preferred version of the adjustable shelf assembly 20, a single shelf extender 64 is used in cooperative movable engagement with one shelf main body 58, as depicted in FIG. 9. The shelf extender 64 is slidably inserted into one end of a shelf main body 58. In a less desirable alternative embodiment of an adjustable shelf assembly 20, two shelf extenders 64 are cooperatively engaged with one adjustable shelf main body 58; in such an alternative configuration, each of two shelf extenders 64 is slidably engaged into a respective end of a shelf main body 58.

Figure 8B:
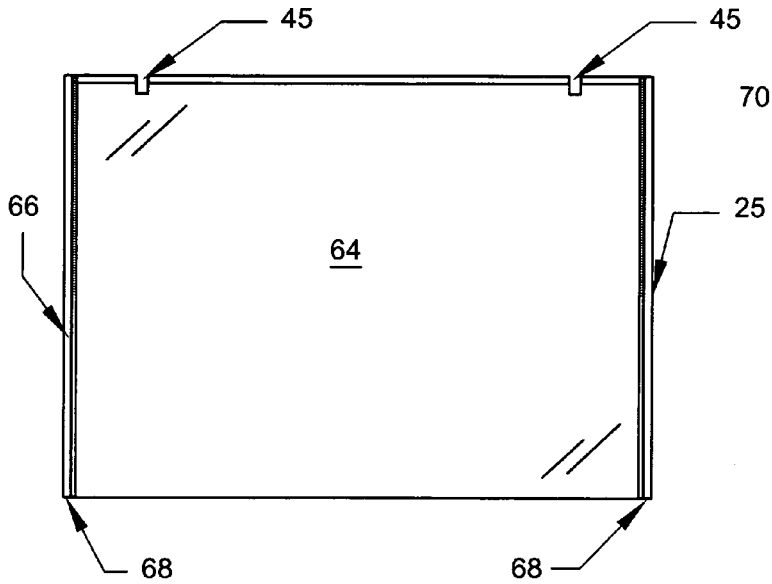
FIG. 8B is a bottom view of the shelf extender component seen in FIG. 8A.
Figure 8C:
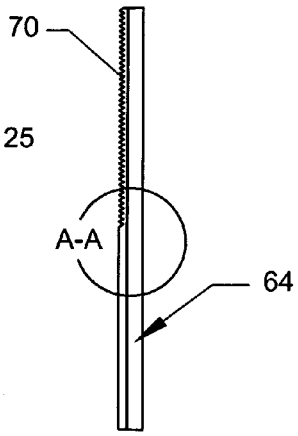
FIG. 8C is a side view of the shelf extender component seen in FIG. 8B.
Figure 8D:
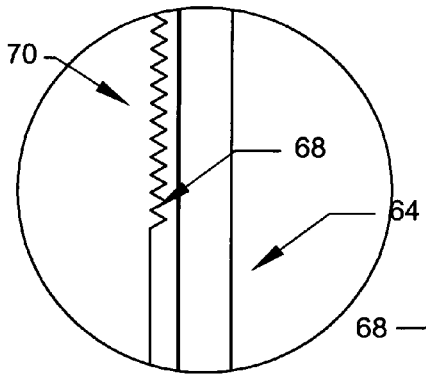
FIG. 8D is an enlarged side view of a portion A-A of the shelf extender component depicted in FIG. 8C.
Figure 8E:
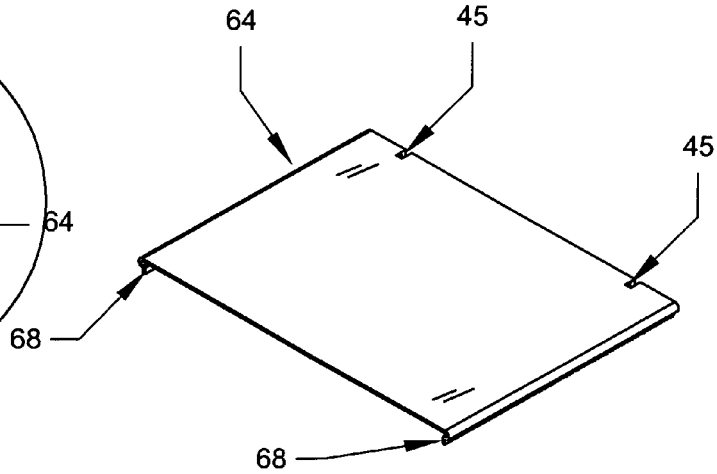
FIG. 8E is a perspective view, from above, of the shelf extender component seen in FIGS. 8A-C.
Figure 9:
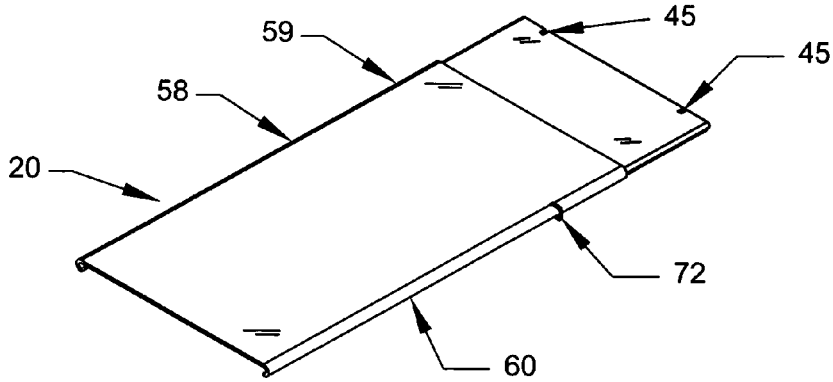
FIG. 9 is a perspective view, from above, of the main shelf body of FIGS. 7A-E slidably coupled with the shelf extender of FIGS. 8A-E, to show an adjustable shelf assembly according to the present system.

A shelf extender 64 is generally rectangular as seen in FIGS. 8B and 8E. An extender 64 preferably is molded from polycarbonate plastic. As seen in FIGS. 8A and 8E, the front edge 66 and the back edge 67 of the shelf extender each defines a curled-under lip 68. The exteriors of the curled lips 68 are complementary in size and shape to the interior surfaces of the two lips 61 on the edges 59, 60 of the main shelf body 58. Accordingly, the lips 61 of the shelf main body 58 can be disposed around the front and back edges 66, 67 of the extender 64.

A shelf extender component 64 in effect thus can be slipped "into" either end of the main shelf body 58 with the lips 68 of the extender 64 in sliding engagement within the complementary lips 61 of the main shelf body 58 (FIG. 9). An extender 64 is placed in registered flush contact with the main body 58, and then slipped along to slidably engage the lips 61 of the main body 58 around the lips 68 of the extender 64. The shelf components 58 and 64 are held flush together in parallel adjacency by the sliding interlock between their respective lips 61 and 68. The shelf components 58, 64 are free to slide axially past each other, but the inter-engagement of the lips 68 about the main shelf body lips 61 maintain the shelf components 58 and 64 in axial parallel relation as seen in FIG. 9, and prevents them from shifting in relation to each other except axially. As mentioned, in a preferred embodiment, a shelf extender component 64 is slidably attached into one end (side) of an adjustable shelf main body 58 (as seen in FIG. 1). (Alternative embodiments within the scope of the present invention may have, however, two extender components 64 slidably engaged with both sides of an adjustable shelf main body 58.)

By controllably moving the (or both) shelf extender component 64 associated with a shelf main body 58, the effective length of the overall adjustable shelf assembly 20 can be selected. Accordingly, by deploying one or more adjustable shelf assemblies 20 incorporating an adjustable shelf main body 58 movably engaged with one or two shelf extenders 64, the effective length of a given shelf assembly can be regulated to adapt it to the distance separating an adjacent pair of panels 10. For example, as seen in FIG. 1, the effective length of the adjustable shelf assembly 20 can be regulated by the user to adapt the assembly to the distance between the right-side inside panel and the right-side outside panel. Again, the distance between any pair of adjacent panels 10 initially is a matter of user choice.

Seen in FIGS. 8A, 8B and 8E are shelf locking notches 45, as previously described in reference to the unitary shelf 18 in FIGS. 3A-B. The lock notches 45 are engageable with locking nubs 46 on the various shelf ledges 26 of the panels. By this means, the end(s) of an adjustable shelf assembly 20 can be reliably interlocked with the respective panel shelf ledges 26, as previously described hereinabove. It will be understood by one skilled in the art that the number and position of locking notches 45 and nubs 46 is not critical, so long as each nub 46 upon a panel shelf ledge 26 (FIG. 2A) corresponds in size and location with a suitable notch 45 in the ends (sides) of the shelf assemblies 18, 20. Again, the engagement of notches 45 around associated nubs 46 helps the user situate and appropriately seat the shelf assemblies 18, 20 upon the shelf ledges 26, and to hold the shelf assemblies in place on the ledges and prevent their shifting (especially front-to-back) on the ledges 26.

Special attention is invited to FIGS. 8B-D, showing that a portion of the inside length of the lips 68 of one embodiment of a shelf extender component 64 is roughly toothed or serrated. The serrated segments 70 of both the lips 68 face downward and are exposed. The serrated segment 70 provides a means whereby the relative positions of the adjustable main shelf body 58 and the shelf extender 64 can be temporarily set by the user.

Figure 10A:
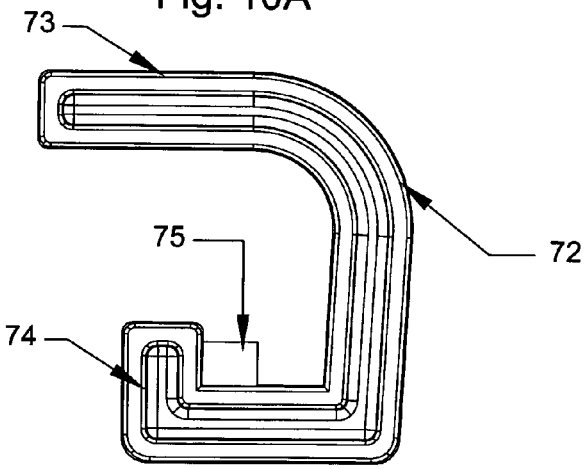
FIG. 10A is a left side view, relatively enlarged, of the shelf clip component of the shelving system according to the present disclosure, usable in connection with the adjustable shelf assembly seen in FIG. 9.
Figure 10B:
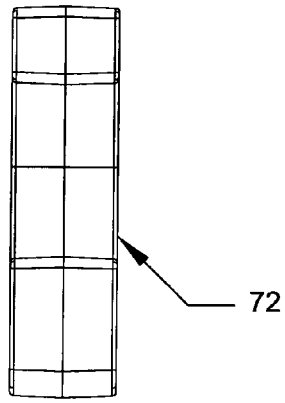
FIG. 10B is a front view of the shelf clip component seen in FIG. 10A.
Figure 10C:
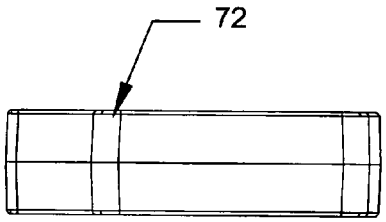
FIG. 10C is a top view of the shelf clip component seen in FIG. 10B.
Figure 10D:
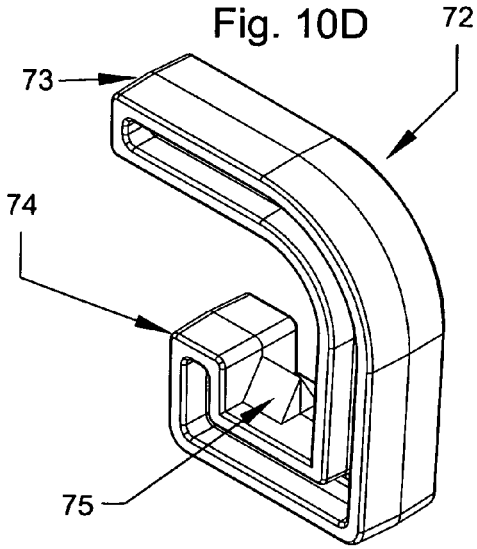
FIG. 10D is a perspective view, from above, of the left side of the shelf clip component seen in FIGS. 10A-C.

FIGS. 10A-D show that there is provided a shelf set clip 72 for use in cooperation with the serrated segment 70 in releasably fixing the shelf components 58 and 64 (of an adjustable shelf assembly 20) against sliding axial movement in relation to each another. The shelf set clip 72 is one piece, and very generally C-shaped, with an upper arm 73 and a lower hooked arm 74. The interior of the lower hooked arm 74 is provided with an upwardly disposed locking tooth 75, as seen in FIGS. 10A and 10D. The shelf set clip 72 preferably is fabricated from elastically resilient ABS plastic or the like.

When the two components 58 and 64 of an adjustable shelf assembly 20 are slidably connected, the user shifts them axially until the desired effective overall length of the assembly 20 is established. The user then places a shelf set clip 72 into position around the lips 61, 68 at the registered front edges 58, 66 of the aligned shelf body 58 and shelf extender component 64, as seen in FIG. 9. To temporarily lock the shelf extender 64 against axial sliding movement relative to the shelf main body 58, the shelf set clip 72 is elastically clipped into place around the front edges of the body 58 and extender 64 immediately adjacent to the corresponding side end of the shelf main body 58. The upper arm 73 is resiliently pressed against the top of the body 58, while the lower arm 74 is pressed against the underside of the front edge of the shelf extender 64; more particularly, the locking tooth 75 of the clip 72 engages with a proximate notch in the serrated segment 70 of the edge of the shelf extender. With the shelf set clip 72 snapped in place on the edge of the shelf extender 64, and with a side of the clip 72 in contact with the side edge of the adjustable shelf main body 58, the shelf extender is prevented from further collapse into the main body 58.

A further advantage of the disclosed system is that it is "forgiving" in the event the user accidentally cuts to short a wardrobe rod 14. In practicing the invention, a user customizes the lengths of the wardrobe rods 14 in the installed system; each rod may be cut to adapt it to the intended design plan for the system and the particular rod's location and role in the system. From time to time, a user may, either through a slight mis-measurement or an inaccurately placed cut, may sever a given rod 14 slightly too short—that is, slightly too short to permit it to reach between its corresponding pair of wardrobe rod hooks 22 (or, more precisely, associated pair of rod hook flanges 44).

Figure 6A:
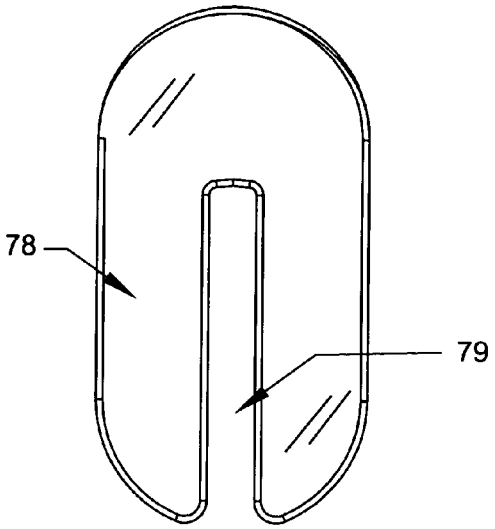
FIG. 6A is an enlarged front view of a spacer usable in conjunction with the hook body component seen in FIGS. 5A-E.
Figure 6B:
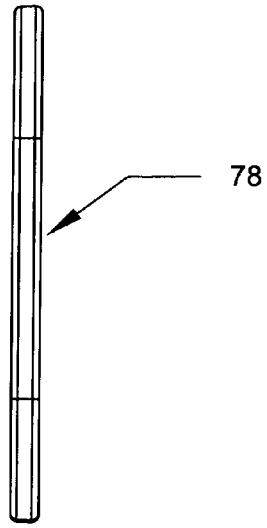
FIG. 6B is a side view of the spacer depicted in FIG. 6A.
Figure 6C:
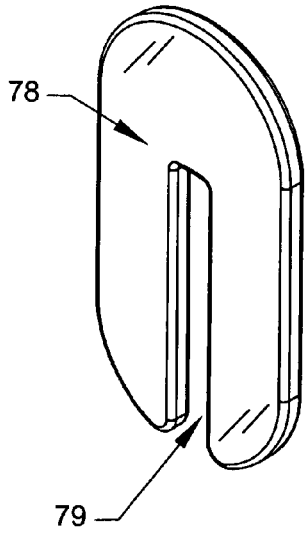
FIG. 6C is a front perspective view of the spacer seen in FIG. 6B.

FIGS. 6A-C depict a spacer 78 that is used in cooperation with a hook body 50 to adapt a slightly too-short wardrobe rod 14 to be utilized. The spacer 78 is composed of an oval planar thin disk of ABS plastic. A spacer 78 is shaped similarly to a support flange 52 on the hook body 50 (FIGS. 5A-E). A spacer 78 is used in cooperation with a hook body 50 to permit the hook body to extend, very modestly, the effective length of a wardrobe rod 14 by allowing the hook body 50 to protrude a slight extra distance from the end of the wardrobe rod 14.

Combined reference is made to FIGS. 5A-C, and 11A and 11B. The directional arrow of FIG. 10A illustrates how the spacer 78 is insertable onto the hook body 50 and into the gap space between the end flange 53 and the first support flange 52 proximate to the end flange 53; the spacer slot 79 slips snugly frictionally over the central beam 51. With the spacer thus fully installed upon the hook body 50 as seen in FIG. 11A, the hook body 50 is then insertable into the end of the wardrobe rod 14 as indicated by FIG. 5A. The hook body 50, with spacer 78 in place thereon (FIG. 11B), is securely inserted into the open end of the wardrobe rod 14 until the spacer 78 (as distinguished from the end flange 53 in an ordinary installation) contacts and abuts the end of the wardrobe rod 14. As a result, the end flange 53, and thus the clip hook 54, extend a modest extra distance (i.e., a distance approximating the axial thickness of the spacer 78), beyond the end of the wardrobe rod 14, then it otherwise would. Consequently, in the event the rod 14 is inadvertently cut slightly too short (i.e., a shortage of up to the thickness of the spacer 78), the hook body 50 can be securely inserted a slightly shorter distance into the end of the rod 14, increasing (with the body 50) the effective length of the rod a distance about equal to the spacer 78. Because a spacer 78 can be used on the hook body 50 that is in each end of the wardrobe rod 14, the usable length of the rod 14 accordingly can be increased by using a spacer 78 on either or both ends of the rod. The effective length of the rod 14 effectively thus is slightly adjustable, even after the rod itself has been cut.

Attention is returned to FIGS. 2A and 2B. A panel 10 optionally but preferably may be provided with a bottom section 28 that has a relatively abbreviated vertical dimension, and may lack a central aperture, having instead a continuous central web. A bottom section 28, such as that seen in FIGS. 2A and 2B, having a smaller overall side profile (compared to the sections above it, a section being defined above and below by adjacent shelf ledges) lends further structural integrity to the panel 10 in the vicinity of the attaching flange 38 by which the bottom of the panel preferably is fastened to the wall. Further, and as seen in FIG. 2B, the front and back frame flanges 25 on the bottom section preferably are not tapered, instead being a uniform substantial lateral thickness throughout their vertical lengths from the top of the section 28 to its bottom. The bottom section 28 nevertheless allows for a bottom-most wardrobe rod hook 22 on the panel at the front of the bottom section 28, as well as a shelf ledge 42 (FIG. 2A) along the top of the bottom section.

Figure 12A:
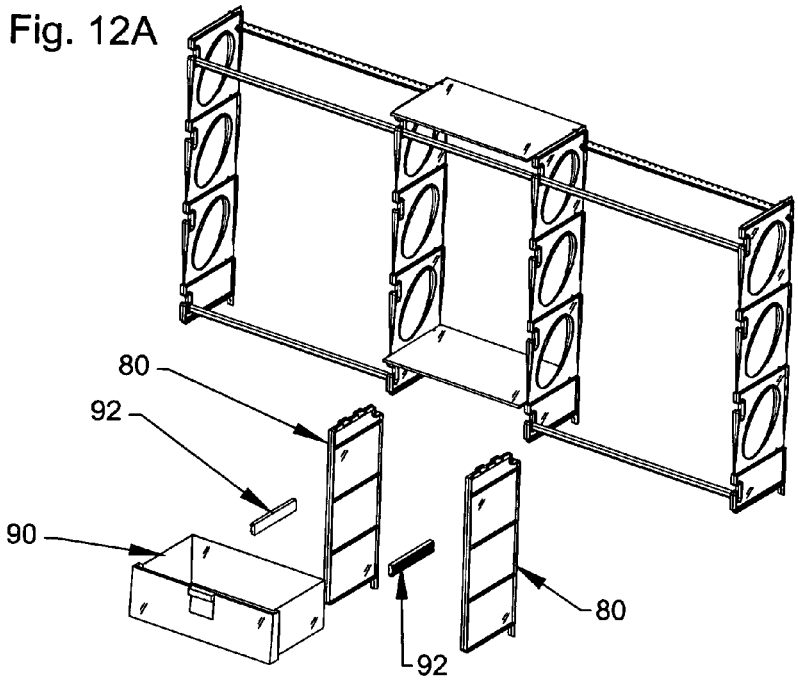
FIG. 12A is an exploded perspective view of an overall system according to the present disclosure and similar to the view of FIG. 1, showing the optional use of a pair of auxiliary panels for the installation of an optional drawer.
Figure 12B:
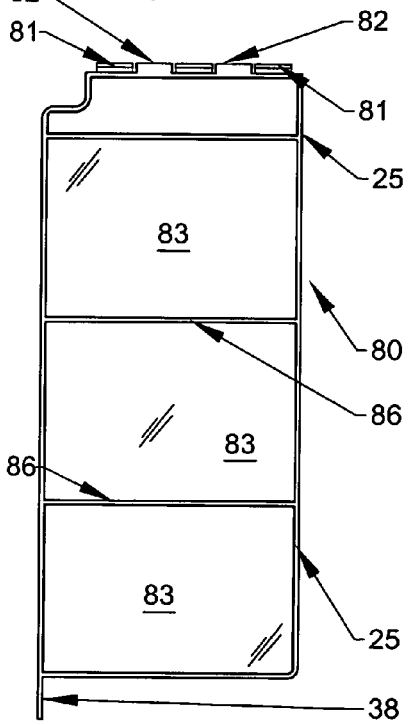
FIG. 12B is a right side view of an auxiliary panel, enlarged relative to FIG. 12A, according to the present disclosure.
Figure 12C:
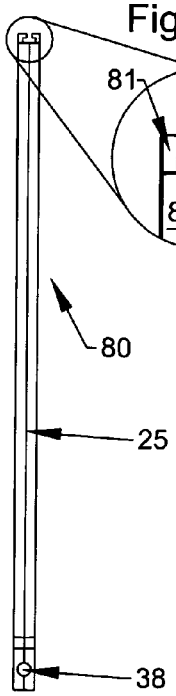
FIG. 12C is a front view of the auxiliary panel seen in FIG. 12B.
Figure 12D:
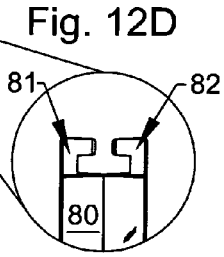
FIG. 12D is an enlarged view of a portion of the top edge of the auxiliary panel depicted in FIG. 12C.

Attention is invited to FIGS. 2A, 2B, and 12A-E. In an alternative embodiment, there optionally may be provided auxiliary panels 80 which may be attached to the bottoms of the main panels 10 to expand the versatility of the system. As suggested by FIG. 12A, a pair of auxiliary panels 80 may be hung vertically from a corresponding adjacent pair of installed main panels 10. An auxiliary panel 80 is similar in many respects to a main panel 10. Like the main panels 10, the auxiliary panels in a given kit or system are all substantially identical in shape and size, and are integrally molded and bilaterally symmetrical about their formational plane. As best seen in FIGS. 12B and 12D, each auxiliary panel 80 preferably features front and back non-tapered frame flanges 25 to promote strength and rigidity. The auxiliary panel has central web 83 extending its full height, with which fixture ledges 86 and frame flanges 25 preferably are integrally formed, as by molding. Also, there are defined in both sides of each auxiliary panel 80 at least one and preferably a plurality of horizontal fixture ledges 86 running front-to-back in the panel 80. A fixture flange 38 with a fastener aperture there-through may depend from the bottom of the back of the auxiliary panel 80.

Figure 12E:
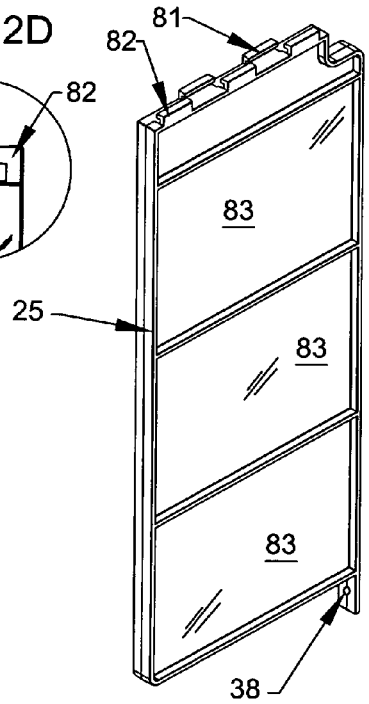
FIG. 12E is a front perspective view, from above, of the auxiliary panel seen in FIGS. 12A-D.

Referring particularly to FIGS. 2A, 2B, and 12B-E, it is seen that a marginal edge holding device along the top of an auxiliary panel 80 is removably engageable with a complementary marginal edge holding device running along the bottom of a main panel 10. Along the topmost edge of a preferred embodiment of the auxiliary panel 80, and as best seen in the enlarged view of FIG. 12D, are inwardly directed inverted L-shaped (in front edge profile, FIGS. 12C and 12D) connector lugs 81, 82. A single pair of long confronting connector lugs 81, 82 may be continuous along the front-to-back length of the top of the auxiliary panel, but for ease of molded fabrication and use of the preferred embodiment there is a series of axially offset discrete lugs 81, 82 projecting inward alternately from the right and left sides of the panel 80 (FIG. 12D). As seen in FIG. 12E, the connector lugs 81, 82 define, in front axial profile, an inverted T-shaped channel.

Depending from and preferably integrally molded with the bottom of a main panel 10 is a connector flange 27 running continuously along a substantial segment of the front-to-back length of the panel bottom. The connector flange 10 is seen in FIGS. 2A and 2B to define a solid inverted T-shape, with a single web depending from the panel 10 and a horizontal legs portion projecting laterally from both sides of the web. The front profile of the connector flange 27 (FIG. 2B) corresponds in general contours shape and size to the channel along the top of an auxiliary panel 80 defined by the connector lugs 81, 82.

The top of an auxiliary panel 80 thus is connectible to the bottom of a main panel 10 by the simple expedient of aligning axially the channel in the connector lugs 81, 82 with the T-shaped connector flange 27, and sliding the connector flange into the connector lugs channel. The lugs 81, 82 snugly but removably engage the connector flange 27, thus reliably connecting together the auxiliary and main panels 80, 10; the auxiliary panel effectively hangs from the bottom of the main panel 10.

The user may select any two or more main panels 10 in a particular installed system, to which any two or more corresponding ones of the auxiliary panels 80 are connected. A pair of adjacently hung auxiliary panels may then be used to expand the versatility and storage capacity of the overall system. For example, one or more shelves (not seen in FIGS. 12A-E) can be disposed between adjacent auxiliary panels 80 by simply resting the ends of a shelf upon those respective fixture ledges 86 in confronting relation, at equal heights, on the two auxiliary panels. The shelf can be either a unitary shelf of fixed length (e.g., unitary shelf 18 in FIG. 1), or may be an expandable shelf assembly 20 as previously described herein. Optionally but not necessarily the fixture ledges 86 may feature locking nubs 46 (not seen in FIGS. 12A-E) as described hereinabove in reference to the shelf ledges 26 of a main panel 10, such that shelves with complementary locking notches 45 can be more securely disposed upon the fixture ledges 86.

Further, and as seen in FIG. 12A, the auxiliary panels 80 may be utilized to adapt the system for the provision of alternative storage means and mechanisms. The regularity and durability of the fixture ledges 86 of the auxiliary panels permits a variety of storage means, such as rimed bins or drawers, to be disposed between a pair of auxiliary panels 80. FIG. 12A illustrates generally that, for example, a pair of drawer slide or roller-bearing hardware kits 92 can be securely mounted by any suitable means to an appropriate pair of opposing fixture ledges 86 facing one another on adjacent auxiliary panels 80. A correspondingly sized drawer 90 can then be operatively connected, as by sliding or rolling in cooperation with the drawer hardware kits 92, to allow the drawer 90 to be used generally conventionally in position between the supporting auxiliary panels 80.

The system is simple, with installation involving a minimal or even no cutting of components. A typical system can be installed with the need to cut nothing except perhaps the hanger track 16 and/or one or more wardrobe hanger rods 14. It is readily possible to locate the two or more main panels 10 of a given system installation so that the need to make lengthy straight-line cuts is eliminated. By disposing some adjacent panels 10 on the track 16 at a separation distance corresponding to the fixed length(s) of one or more unitary shelves 18, the unitary shelves are placed between panels without any cutting. Expandable shelf assemblies 20 may be used in those instances where the separation distance between a pair of adjacent panels 10 has been selected arbitrarily by the user.

A further observation regarding the system of the disclosure is that its function and system layout is readily changeable without the need for extensive dismantling and reconstruction. Many known shelving systems, after they are installed, are difficult or even impossible to reconfigure in any appreciable degree to accommodate updated or alternative storage patterns or needs. The presently disclosed system is easily modified by the simple expedient of adding or removing panels 10 from the hanger track 16 or by shifting the lateral position (right or left) of one or more panels relative to the axis of the track, and then adding, omitting and/or replacing shelves 18, 20. Relocating or adding any panel is simple because the mounting of a panel on a wall is accomplished merely by hanging it track hook notch 36 on the track 16 (no fastener needed for the engagement) and removing/replacing the single fastener through the attaching flange 38. The comparatively large sizes of the hook portion 33 of the track 16, and of the hook notch 36 eliminate the need to insert a plurality of small hooks into relatively narrow little slits, as is encountered in some conventional shelving systems.

As evident from this disclosure, therefore, the function of an installed system is easily changed. For example, without removing or even moving any panels 10, a user may be able to attach auxiliary panels 80 to the bottoms of existing main panels 10, and dispose on the auxiliary panels one or more additional shelves 18 or 20, or drawers 90 (FIG. 12A). A user can start with a basic system (e.g., FIG. 1), and then later add additional panels 10 and/or 80 to it, as well additional shelves or expandable shelf assemblies (e.g., FIG. 12A), without having to completely remove the preexisting basic system from the wall and dismantling and re-assembling it.

The integral, uni-body character of each panel 10 (regardless of its overall size or number of vertical cell sections) lends considerable overall strength to an installed system. Weight forces of the system and items stored thereon is relatively dispersed, reducing the number component-to-component connections and other points of force concentration that may lead to failure in known, more complex multi-component systems. Small hooks (e.g., approximately 1.0 cm by 0.4 cm) engaged into narrow slots of corresponding size in some previously known systems are force concentrators and locations prone to failure. Weight placed by storage items situated by a user upon a shelf or wardrobe rod is transmitted efficiently to the hanger track 16, resulting in that much of the total weight force is directed vertically downward at the track 16 near the wall, rather than upon a cantilever—increasing the security of the installed system.

A mode of installing the system is apparent from the foregoing, but may be briefly summarized. The user brings the unassembled system to the installation location. The side-to-side width of the overall assembly is determined, and the hanger track 16 is cut with a hacksaw to the desired system width (i.e., length along the wall). The desired height of the hanger track 16 above the floor (e.g., 195 cm) is measured and, using a level, a horizontal line is marked on the wall 15. The wall studs in the wall 15 are located and marked. The number and locations of the vertical panels is selected and determined, and the locations of the plurality of panels 10 are marked on the wall 15. If a particular panel 10 is not within about 7.5 cm of a wall stud, a toggle bolt may be required (according to convention) to attach the hanger track 16 to the wall. Alternatively drywall screw anchor sockets may be installed, if acceptable. To determine the location of a toggle bolt, the track 16 is positioned over the horizontal marked line, and hole locations are marked near vertical panel locations, and the next-to-last hole on each end of the track 16 are marked. It is important not to use track holes 34 situated directly behind the selected locations of the panels 10; rather, holes 34 adjacent to panel locations are used. Ends of the hanger track 16 are not left unsupported; using the last end hole 34 or next-to-last hole near the ends of the track, position and fix an anchor fastener (into stud or via toggle bolt). Each 120 cm length of hanger track 16 generally requires at least four anchor fasteners.

Pilot holes may be drilled into marked studs. (If mounting into concrete or block, specialized attachment means known in the construction industry may need to be utilized.) The hanger track 16 is appropriately positioned and fastened to the wall 15 until securely flush thereto. The number and placement of the plurality of panels 10 is then implemented by hanging each panel 10 in its selected location along the axial length of the hanger track 16. Each panel 10 is suspended from the track 16 at its calculated position be engaging the hook 33 of the track into the hook notch 36 on the back of the panel 10. The configuration of the system thereafter is the option and calculation of the user. For example, the location (s) of the unitary shelve(s) 18 may first be determined, and a pair of "inside" panels appropriately positioned therefore. The two inside panels 10 are placed, engaging their panel hook notches 36 with the track 16, and their bottoms are fastened to the wall 15 using the screw flange 38 and screw aperture 39. The length(s) of desired wardrobe rods 14 are determined, and the rods measured and cut to appropriate length(s). Hook bodies 50 are inserted into the ends of pre-cut (e.g., 60 cm) wardrobe rods 14. The 60 cm wardrobe rods 14 are disposed into respective wardrobe rod hooks 22 in the two center panels 10 (which correspondingly are separated by approximately 60 cm). The user-selected remaining panels, if any, (e.g., a pair of outside panels 10) are placed into position at the demarked ends of the overall installation, and hung in place using the engagement with the track 16 and the screw through screw aperture 39 at bottom flange of each outside panel.

The separation distance between each outside panel 10 and its adjacent intermediate or inside panel is measured to determine the appropriate length of associated wardrobe rods 14. The "outside" rods 14 are cut to length using a hacksaw. A hook body 50 is inserted into each end of each custom-cut length of wardrobe rod 14. If a rod 14 is cut short, and does not fit snugly into both wardrobe rod hooks 22 in the associated pair of panels, a spacer 78 is inserted between the end of the rod 14 and the end flange 52 of the associated hook body 50 at that end of the rod, so that the clip hook 54 is extended to be able to engage with the rod hook flange 44 in the appropriate rod hook 22. If the effective length of the rod 14 is still not long enough, the spacer-insertion process is repeated at the other end of the rod.

The fixed-dimension unitary shelf assemblies 18 are disposed into proper place, resting their ends upon respective shelf ledges 26 in confronting relation at the same height on adjacent panels 10 (for example, a pair of adjacent inside panels). If adjustable shelf assemblies 20 are used, each assembly 20 is adjusted to its appropriate effective length (e.g., the distance between an intermediate or inside panel 10 and its adjacent outside panel). The selected effective length (s) of the adjustable shelf assemblies 20 are temporarily but securely fixed by the use of the shelf set clips 72. The adjustable shelf assemblies 20 are disposed between corresponding pairs of adjacent panels 10, resting their ends upon respective corresponding shelf ledges 26 in confronting relation at the same height on the adjacent panels (FIG. 1). Alternatively, after an adjustable shelf assembly 20 has been adjusted in length and disposed in place resting upon the ledges 26 of adjacent parallel panels, the shelf set clip(s) 72 can then be clipped on shelf extender component(s) 64 to fix the length of the adjustable shelf assembly 20.

Although the invention has been described in detail with particular reference to these preferred embodiments, other embodiments can achieve the same results. From the foregoing, those skilled in the art will recognize an advancement of this invention in a crowded field of prior art. While the invention has been described in relation to a preferred embodiment thereof shown in the accompanying drawings, it also is to be recognized that the same is readily susceptible to modification, variation and substitution of equivalents without avoiding the invention. The system and apparatus are not intended to be limited by the foregoing except as may appear in the following appended claims, and it is intended to cover in the claims all such modifications and equivalents.

What is claimed is:

1. A shelving system for installation upon a wall, comprising:

a hanger track mountable substantially horizontally upon a wall;

at least two main panels hangable vertically in mutually parallel relation upon the hanger track and substantially perpendicular to the wall, each of the at least two main panels having a formational plane of symmetry and being molded integrally to define on each of the main panels:

a panel left side, a panel right side, a panel front having a front edge, and a panel back;

a web;

a hook notch in the panel back, engageable with the hanger track whereby the main panel may hang by gravity upon the hanger track;

at least one wardrobe rod hook defined as a concave notch in the front edge and extending down and into the web;

at least four shelf ledges comprising at least one left side upper shelf ledge defined at a shelf separation distance above at least one left side lower shelf ledge, and at least one right side upper shelf ledge defined the shelf separation distance above at least one right side lower shelf ledge, said shelf ledges extending from the panel front to the panel back; wherein the panel right side and panel left side are substantially bilaterally symmetrical about the formational plane of symmetry;

a back frame flange projecting laterally from the sides of the main panel at the back of the main panel and extending a distance less than the shelf separation distance downward from the upper shelf ledges;

a front frame flange projecting laterally from the sides of the main panel at the front of the main panel and extending a distance less than the shelf separation distance downward from the upper shelf ledges;

at least one wardrobe rod having two opposite ends, each end engageable with respective wardrobe rod hooks of two adjacent panels of the at least two main panels; and at least one shelf disposable between the two adjacent panels, each end of each shelf resting upon respective shelf ledges of the two adjacent panels;

wherein each frame flange descends on each main panel from one of the upper shelf ledges toward one of the lower shelf ledges, and is tapered downward to decrease progressively in lateral extent as the frame flange descends from the one upper shelf ledge to approach the one lower shelf ledge below the frame flange, there being a vertical gap between the bottom of the frame flange and the lower shelf ledge.

2. A system according to claim 1 wherein the at least one wardrobe rod hook is molded integrally in the panel front below each shelf ledge.

3. A system according to claim 1 wherein the opposite ends of the wardrobe rod are hollow, and further comprising hook bodies insertable into each end of the wardrobe rod, the hook bodies engageable with respective wardrobe rod hooks of the two adjacent main panels.

4. A system according to claim 3 wherein each hook body comprises:

a central beam;

a plurality of mutually parallel planar support flanges fixed along the central beam, an exterior contour defined by the perimeter of each support flange corresponding to the interior contour of apertures in open ends of the wardrobe rod;

wherein the support flanges are firmly and snugly disposable into each open end of the wardrobe rod.

5. A system according to claim 4 wherein each of the at least one wardrobe rod hook comprises a vertical hook flange within the notch of the rod hook; and each hook body further comprises:

an end flange on an end of the central beam; and a clip hook extending from a top of the end flange;

wherein the clip hook is engaged with an associated vertical hook flange when the hook bodies are engaged with respective wardrobe rod hooks of the two adjacent main panels.

6. A system according to claim 4 further comprising a planar spacer removably insertable between selected adjacent support flanges of at least one of the hook bodies, wherein the spacer is co-operable with the at least one hook body to permit the hook body to protrude from an end of the wardrobe rod to extend an effective length of the wardrobe rod.

7. A system according to claim 1 wherein said at least one shelf comprises an adjustable shelf assembly comprising:

a shelf main body comprising a shelf front edge and a shelf back edge, each of the shelf front edge and the shelf back edge defining a curled-under C-shaped lip;

a shelf extender comprising an extender front edge and an extender back edge, each of the extender front edge and the extender back edge defining a curled-under C-shaped lip, and at least one of the extender edges defining a serrated segment thereon; wherein the shelf main body and the shelf extender are disposable in parallel sliding contact with their respective C-shaped lips in axial sliding engagement, thereby movably connecting the shelf main body to the shelf extender to permit an effective length of the shelf assembly to be selectively adjusted; and a shelf set clip positionable around adjacent edges of the shelf main body and the shelf extender when the shelf main body and the shelf extender are disposable in parallel sliding contact, the shelf set clip engageable with the serrated edge thereby to temporarily lock the shelf extender against axial sliding movement relative to the shelf main body.

8. A shelving system for installation upon a wall, comprising:

a hanger track mountable substantially horizontally upon a wall;

at least two main panels hangable vertically in mutually parallel relation upon the hanger track, each of the at least two main panels having a formational plane of symmetry and each main panel being molded integrally to define on each of the main panels:

a panel left side, a panel right side, a panel front and a panel back;

a hook notch in the panel back, engageable with the hanger track whereby each main panel may hang by gravity upon the hanger track;

at least one wardrobe rod hook defined in the panel front;

at least four shelf ledges, comprising at least one left side upper shelf ledge defined a shelf separation distance above at least one left side lower shelf ledge, and at least one right side upper shelf ledge defined the shelf separation distance above at least one right side lower shelf ledge;

a back frame flange projecting laterally from the sides of each main panel at the back of the main panel and extending a distance less than the shelf separation distance downward from the upper shelf ledges;

a front frame flange projecting laterally from the sides of each main panel at the front of the main panel and extending a distance less than the shelf separation distance downward from the upper shelf ledges; and a web extending between one of said upper shelf ledges and one of said lower shelf ledges; and at least one wardrobe rod having two opposite ends, each end engageable with respective wardrobe rod hooks of two adjacent panels of the at least two main panels; wherein each said frame flange descends on one of the main panels from one of the upper shelf ledges toward one of the lower shelf ledges, and is tapered downward to decrease progressively in lateral extent as the frame flange descends from the one upper shelf ledge to approach the one lower shelf ledge below the frame flange, there being a vertical gap between the bottom of the frame flange and the lower shelf ledge.

9. A system according to claim 8 wherein the opposite ends of the wardrobe rod are hollow, and the at least one wardrobe rod hook is defined as a concave notch in a front edge of the panel front and extending down and into the web, and further comprising:

hook bodies insertable into each end of the wardrobe rod, the hook bodies engageable with respective wardrobe rod hooks of the two adjacent main panels; wherein each hook body comprises:

a central beam;

a plurality of mutually parallel planar support flanges fixed along the central beam, an exterior contour defined by the perimeter of each support flange corresponding to the interior contour of apertures in open ends of the wardrobe rod;

wherein the support flanges are firmly and snugly disposable into each open end of the wardrobe rod.

10. A system according to claim 9 wherein each of the at least one wardrobe rod hook comprises a vertical hook flange within the notch of the rod hook, and each hook body further comprises:

an end flange on an end of the central beam; and a clip hook extending from a top of the end flange;

wherein the clip hook is engaged with an associated vertical hook flange when the hook bodies are engaged with respective wardrobe rod hooks of the two adjacent main panels.

11. A system according to claim 10 further comprising a planar spacer removably insertable between selected adjacent support flanges of one of the hook bodies, wherein the spacer is co-operable with the one hook body to permit the hook body to protrude from an end of the wardrobe rod to extend an effective length of the wardrobe rod.

12. A system according to claim 8 further comprising at least one adjustable shelf assembly comprising:

a shelf main body comprising a shelf front edge and a shelf back edge, each of the shelf front edge and the shelf back edge defining a curled-under C-shaped lip;

a shelf extender comprising an extender front edge and an extender back edge, each of the extender front edge and the extender back edge defining a curled-under C-shaped lip, and at least one of the extender edges defining a serrated segment thereon; wherein the shelf main body and the shelf extender are disposable in parallel sliding contact with their respective C-shaped lips in axial sliding engagement, thereby movably connecting the shelf main body to the shelf extender to permit an effective length of the shelf assembly to be selectively adjusted; and a shelf set clip positionable around adjacent edges of the shelf main body and the shelf extender when the shelf main body and the shelf extender are disposable in parallel sliding contact, the shelf set clip engageable with the serrated edge thereby to temporarily lock the shelf extender against axial sliding movement relative to the shelf main body.

* * * * *